US005345035A

United States Patent [19]

Yamada

[11] Patent Number: 5,345,035

[45] Date of Patent: Sep. 6, 1994

[54] MUSICAL TONE GENERATING APPARATUS

[75] Inventor: Hideo Yamada, Hamamatsu, Japan

[73] Assignee: Yamaha Corporation, Japan

[21] Appl. No.: 89,091

[22] Filed: Jul. 8, 1993

[30] Foreign Application Priority Data

Jul. 10, 1992 [JP] Japan ..... 4-184185
Jul. 10, 1992 [JP] Japan ..... 4-184186

[51] Int. Cl.[5] ..... G10H 1/06
[52] U.S. Cl. ..... 84/622
[58] Field of Search ..... 84/622–625

[56] References Cited

U.S. PATENT DOCUMENTS 4,984,497 1/1991 Inagaki et al. ..... 84/622 X

*Primary Examiner*—Stanley J. Witkowski
*Attorney, Agent, or Firm*—Graham & James

[57] ABSTRACT

A musical tone generating apparatus, to be applied to an electronic musical instrument, provides at least a plurality of channels and a tone-color memory. Each channel contains one tone generator and two or more buffers. The number of the buffers provided in a plurality of channels is set smaller than the number of tone colors stored in the tone-color memory. Each of the buffers stores one tone color, so that the tone generator creates a musical tone signal responsive to the tone color stored in the buffer in accordance with musical tone information given from an external device such as a keyboard. The tone colors to be used in a tune to be performed can be freely assigned to the buffers in advance. Herein, all of the buffers are classified into two or more groups in accordance with a buffer-grouping priority, so that in a plurality of channels, when a musical-tone generation is assigned to a channel, one buffer given a higher priority is selected prior to another buffer. In a case where an automatic performance is played based on musical tone information read from a memory, the tone-color assignment to the buffers is determined responsive to a maximum number of the musical tones to be simultaneously produced with respect to each of the tone colors corresponding to the musical tone information. When a new musical-tone generation is designated, one of the channels is automatically selected in accordance with the buffer-grouping priority.

6 Claims, 28 Drawing Sheets (FIRST EMBODIMENT)

FIG. 1 (FIRST EMBODIMENT)

23

| CH | GROUP 1 | GROUP 2 |
|---|---|---|
| 0 | BRASS | PIANO |
| 1 | PERC. | PIANO |
| 2 | PIANO | STRINGS |
| 3 | PIANO | STRINGS |
| 4 | PIANO | STRINGS |
| 5 | STRINGS | PIANO |
| 6 | STRINGS | PIANO |
| 7 | REED | PIANO |

FIG.2

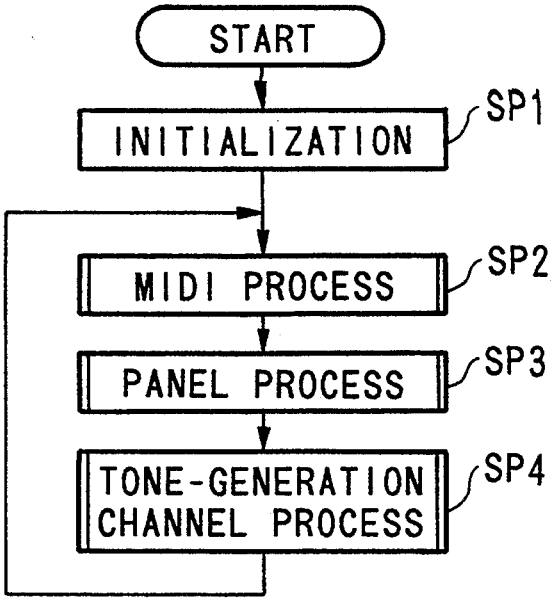
FIG.4 (MAIN ROUTINE)
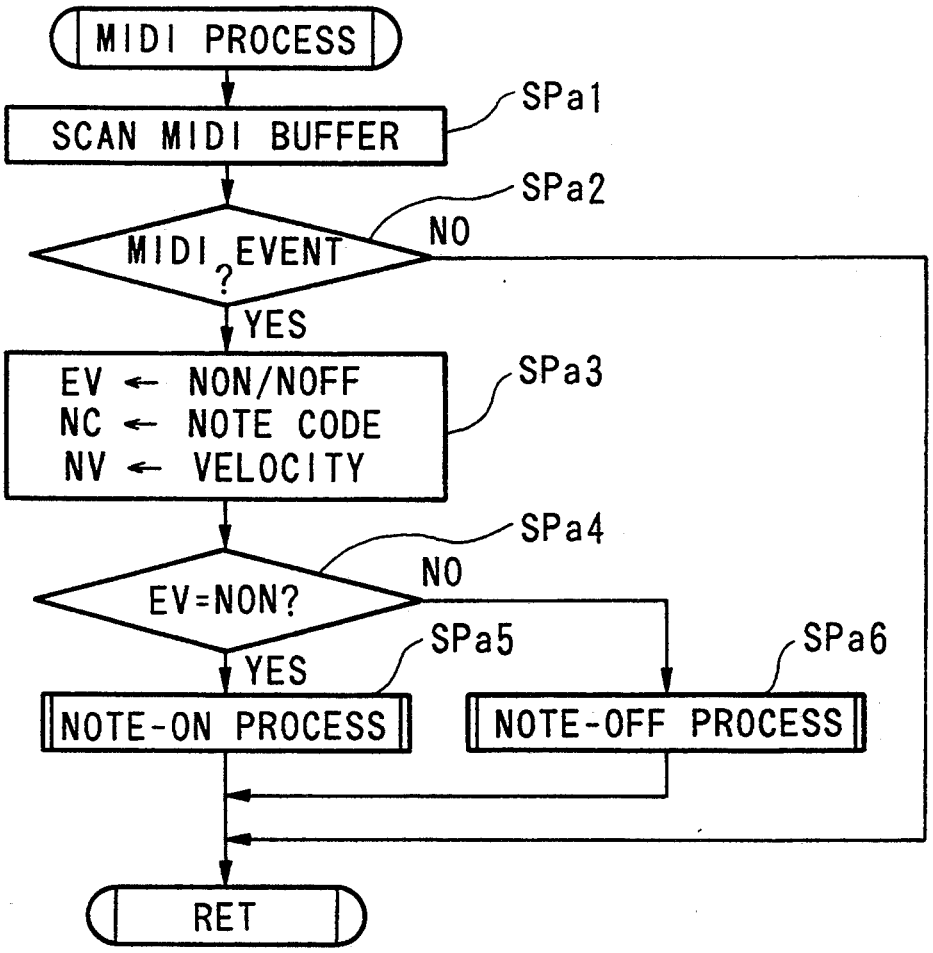
FIG.5

SUSTAIN-TYPE TONE

DECAY-TYPE TONE

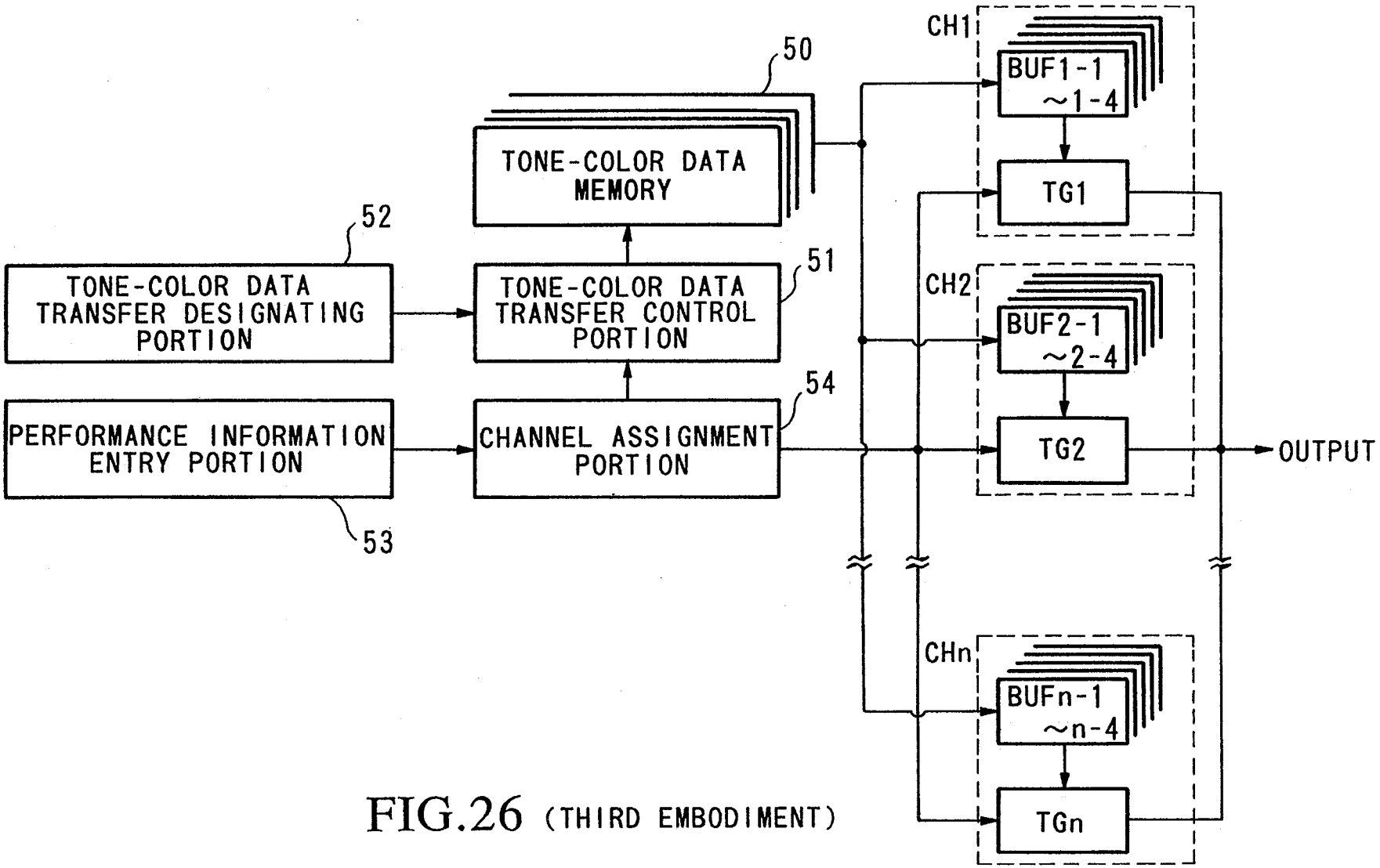
FIG.26 (THIRD EMBODIMENT)

| | BUFx1 | BUFx2 | BUFx3 | BUFx4 |
|---|---|---|---|---|
| CH 1 | PIANO | GUITAR | STRING | BRASS-3 |
| CH 2 | PIANO | GUITAR | STRING | BRASS-3 |
| CH 3 | PIANO | GUITAR | STRING | BRASS-3 |
| CH 4 | PIANO | GUITAR | STRING | BRASS-3 |
| CH 5 | PIANO | GUITAR | STRING | BRASS-3 |
| CH 6 | GUITAR | PIANO | BRASS-3 | SAXOPHONE-1 |
| CH 7 | GUITAR | PIANO | BRASS-3 | SAXOPHONE-1 |
| CH 8 | GUITAR | PIANO | BRASS-3 | SAXOPHONE-1 |
| CH 9 | STRING | GUITAR | BRASS-3 | PIANO |
| CH10 | BRASS-1 | BRASS-2 | BRASS-3 | PIANO |
| CH11 | SAXOPHONE-1 | SAXOPHONE-2 | SAXOPHONE-3 | PIANO |
| CH12 | BASS | STRING | BRASS-3 | PIANO |

FIG.27

MUSICAL TONE GENERATING APPARATUS

BACKGROUND OF THE INVENTION

The present invention relates to a musical tone generating apparatus which is suitable for use in an electronic musical instrument when simultaneously or respectively generating a plurality of musical tones.

Recently, several kinds of attempts are made to the electronic musical instruments in order that plural musical tones can be produced by plural tone colors. In order to do so, two kinds of designs are proposed and applied to a tone generator (i.e., sound source) of the electronic musical instrument. In a First type, the operation o:f the tone generator is switched over in a time division manner so as to eventually and simultaneously produce plural sounds. In a second type, plural tone generators are simultaneously activated so as to simultaneously produce plural sounds. Hereinafter, the First type is simply referred to as a time-division type, while the second type is simply referred to as a non-time-division type. Either tile time-division type or the non-time-division type of the electronic musical instrument determines the tone color by setting tone color data, specifying a certain tone color, to time tone generator.

FIG. 28 is a block diagram slowing an example of the time-division-type electronic musical instrument. In FIG. 28, a numeral 1 designates a performance information entry portion, which is configured by a keyboard providing plural keys or a sequencer unit functioning to deliver performance information in accordance with a progress of a tune to be performed, for example. The performance information entry portion 1 delivers key-on/off information, tone pitch information, tone color information and the like. For convenience' sake, these pieces of information are referred to as musical tone information, while the performance information represents key information only. A tone generator 3 produces a musical tone signal on the basis of the musical tone information which is supplied thereto by means of a channel assignment portion 2. The tone generator 3 provides plural tone-generation channels which are switched over in a time division manner. Further, the channel assignment portion 2 assigns the musical tone information, which is supplied thereto from the performance information entry portion 1, to each of the tone-generation channels. Incidentally, the tone-generation channel does not merely represent an electronic transmission path but it represents a store accompanied with peripheral circuits which is accessible to a reading station or the like.

Numerals 4-1 through 4-m (where m denotes an integer number) designate tone-color data memories each capable of storing different tone color data. The tone color data stored in each of the memories Indicates a specific one tone color. Thus, the tone color data stored in each of the memories 4-1 through 4-m is used in the corresponding tone-generation channel (hereinafter, simply referred to as a channel) in the tone generator 3 which is accessed in a time division manner.

FIG. 29 is a block diagram showing an example of the non-time-division-type electronic musical instrument which provides plural tone generators. Herein, plural tone generators TG1 through TGn (of which number is equal to "n", where n denotes an integer number) are provided. Each of the tone generators TG1 through TGn is accompanied with each of buffers BUF1 through BUFn which are provided to store the tone color data. Thus, each of channels CH1 through CHn is constructed by a combination of the tone generator and the buffer. Under the control of a tone-color-data transfer control portion 6, one of the tone-color data memories 4-1 through 4-m, which corresponds to the tone color designated by the tone color data, is selected in accordance with a channel assignment process which is carried out by the channel assignment portion 2, so that the tone color data is transferred to the buffer provided in the selected channel.

In the above-mentioned electronic musical instrument, when a key-on event is occurred, a tone-generation task for generating a musical tone designated by an operated (or depressed) key corresponding to the key-on event is assigned to one of the channels CH1 through CHn. At the same time, the tone color data corresponding to the key is transferred to the buffer provided in the channel to which the tone-generation task is assigned. Thus, the tone generator functions to create a musical tone signal in response to the tone color data stored in the buffer in the channel.

In the time-division-type instrument as shown in FIG. 28, the tone color data stored in each of the tone-color data memories 4-1 through 4-m must be transferred to each of the channels performing a time-division process at a channel switch-over timing. Therefore, an extremely high processing speed is required to do so. Actually, however, it is difficult to follow up with a change of the key-on event occurred on each of the keys. Particularly, in the case where the tone generator carries out a tone-generation process in accordance with an algorithm simulating a tone-generating operation of a non-electronic musical instrument, micro-programs are transferred to the channel as the tone color data, which results in an increase of an amount of the data to be transferred. Thus, the above-mentioned difficulty is emerged remarkably.

In the non-time-division-type instrument as shown in FIG. 29, there are provided plural tone generators which operate in a parallel manner. Therefore, once the tone color data is transferred to the buffer, a high-speed processing is not required in each of the channels. In contrast, however, every time a key-on event is occurred, it is necessary to transfer the tone color data to each of the buffers BUF1 through BUFn. Thus, if the amount of the tone color data is relatively large, as similar to the foregoing case of the time-division-type instrument shown in FIG. 28, a response ability against a key-on event to be occurred must be deteriorated. This is not practical.

In order to overcome the difficulties described above, the electronic musical instrument can be modified as shown in FIG. 30 such that each channel provides plural buffers of which number corresponds to the number of the tone colors to be used. In this instrument, all of the tone color data are transferred to each of the channels in advance. In this instrument, the tone generator TG1 can directly read out the desired tone color data from one of the buffers BUF1-1 through BUF1-m which are provided in parallel in the channel CH1, for example. Therefore, it is not necessary to transfer the tone color data from the tone-color data memory every time a key-on event is occurred. The other tone generators TG2 through TGn can operate in a similar manner of the tone generator TG1. Thus, it is possible to improve the response ability against the key-on event (hereinafter, simply referred to as a key-on response).

However, the whole capacity of the buffers provided in each channel must be set in response to the amount of all of the tone color data to be required for each channel. This cause a large increase of the memory capacity of the instrument.

In the meantime, when playing an automatic performance, plural pieces of the musical tone information are sequentially read from storage units, and a specific tone color is selectively used for simultaneously producing plural musical tones. In this case, it is necessary to efficiently assign the musical tone information, representing each of the tone colors, to the channel. In the instrument as shown in FIG. 30 which provides an increased number of the buffers for each of the channels, it is possible to simultaneously produce plural musical tones by use of the specific tone color. However, there is a drawback in that the memory capacity must be inevitably enlarged. If the number of the buffers is reduced in order to reduce the memory capacity, however, the number of the musical tones which are simultaneously produced by use of the specific tone color must be limited.

SUMMARY OF THE INVENTION

It is accordingly a primary object of the present invention to provide a musical tone generating apparatus which can improve a key-on response without substantially enlarging the capacity of the buffer storing the tone color data.

It is another object of the present invention to provide a musical tone generating apparatus which can efficiently assign the tone colors to the musical tone information when playing the automatic performance.

In order to achieve the primary object, the musical tone generating apparatus according to the present invention, which can produce the musical tone signals having the tone colors corresponding to the musical tone information given from an external device, is designed to provide a plurality of tone-generation channels. Each of the tone-generation channels provides a tone generator and one or more buffers. The total number of the buffers is set equal to "m" (where m denotes an integer number). For example, each tone-generation channel can provide one tone generator and two buffers. Herein, each of the buffers can store different tone-color data, while each of the tone generators can generate a musical tone signal corresponding to the tone-color data given from the buffer. Moreover, the musical tone generating apparatus further provides a tone-color data storing portion, a tone-color designating portion, a transfer portion and an assignment control portion. The tone-color data storing portion is designed to store plural kinds of tone-color data of which number is set at "n" (where n is an integer number, and n is larger than m). The tone-color designating portion designates one of the tone colors for each of the buffers. The transfer portion transfers the tone-color data designated by the tone-color designating portion to each of the buffers. All of the buffers are classified into two or more groups in accordance with a predetermined priority order. When selecting the buffer storing the tone-color data which corresponds to the musical tone information, the assignment control portion searches the buffers in accordance with the priority order. So, a certain group of buffers given a first priority are searched first. Then, a tone-generation task for producing a musical tone signal is assigned to the tone-generation channel which provides a selected buffer.

According to the above-mentioned configuration of the musical tone generating apparatus, it is not necessary to provide each of the tone-generation channels with all off the tone-color data to be used. In contrast, desired tone-color data can be transferred to the buffer in advance, so that the tone-generation channel can smoothly create a musical tone signal having a desired tone color.

In order to achieve another object, the musical tone generating apparatus is modified such that the musical tone information is read from a storage medium, and then, the musical tone signals are produced by use of the tone colors corresponding to the read musical tone information so as to play the automatic performance. This musical tone generating apparatus (which functions as the automatic performance apparatus) further contains a detecting portion and a tone-color assignment control portion other than the aforementioned portions and the like. 0n the basis of the read musical tone information, the detecting portion detects a maximum number of the musical tones which are simultaneously produced with respect to each of the tone colors. The tone-color assignment control portion controls the tone-color designating portion such that the tone color of which maximum number of the musical tones to be simultaneously produced is larger is selected prior to the other tone colors, and the tone color which is not actually used when producing the musical tones is not designated by the tone-color designating portion. Thus, it is possible to efficiently perform the tone-color assignment when producing the musical tones.

BRIEF DESCRIPTION OF THE DRAWINGS

Further objects and advantages of the present invention will be apparent from the following description, reference being had to the accompanying drawings wherein the preferred embodiments of the present invention are clearly shown.

In the drawings:

FIG. 2 is a table of which contents represents a stored contents of a tone-color assignment buffer used in the first embodiment;

FIG. 4 is a flowchart showing a main routine of the first embodiment;

FIG. 5 is a flowchart showing a subroutine for a MIDI process;

FIG. 26 is a block diagram showing an electronic configuration of the musical tone generating apparatus according to a third embodiment of the present invention;

FIG. 27 is a table showing a contents of a tone-color assignment buffer used for the third embodiment;

DESCRIPTION OF THE PREFERRED EMBODIMENTS

[A] Configuration of First Embodiment

Figure 1:
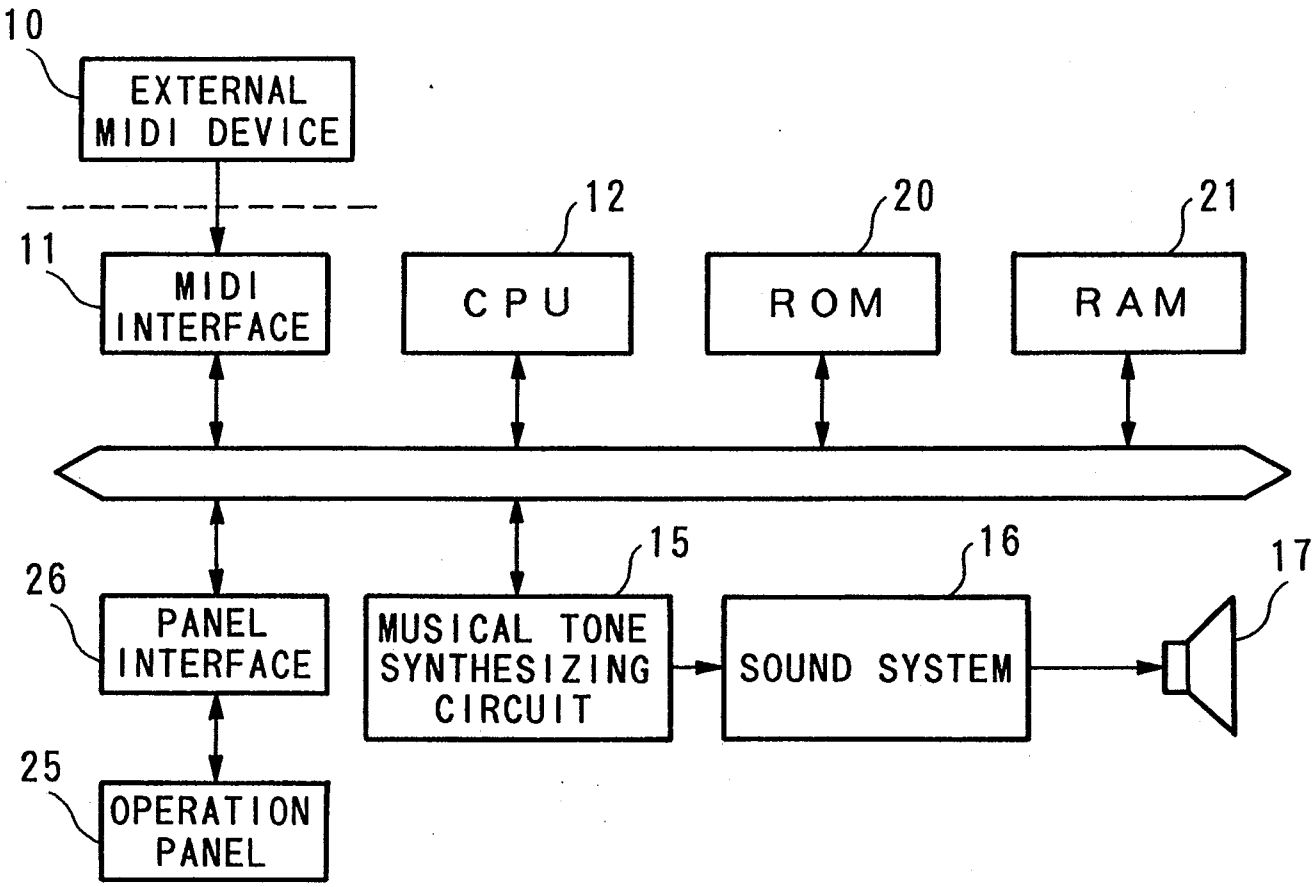
FIG. 1 is a block diagram showing an electronic configuration of the musical tone generating apparatus according to a first embodiment of the present invention.

FIG. 1 is a block diagram showing an electronic configuration of a musical tone generating apparatus according to a first embodiment of the present invention. In FIG. 1, 10 designates an external MIDI device which is externally connected to this musical tone generating apparatus, whereas "MIDI" represents a standard for Musical Instruments Digital Interface. As the external MIDI device 10, a keyboard unit can be employed. In this case, the external MIDI device 10 creates the musical tone information containing note-on/note-off information (represented by "NON/NOFF"), a note code NC representing a tone pitch of the key to be operated, velocity data NV representing a key-depression velocity and the like. The above-mentioned musical tone information is supplied to a central processing unit (i.e., CPU) 12 by means of a MIDI interface 11. The CPU 12 performs several kinds of processes, which will be described later in detail, on the musical tone information supplied thereto, and it also controls several portions of the apparatus.

Figure 3:
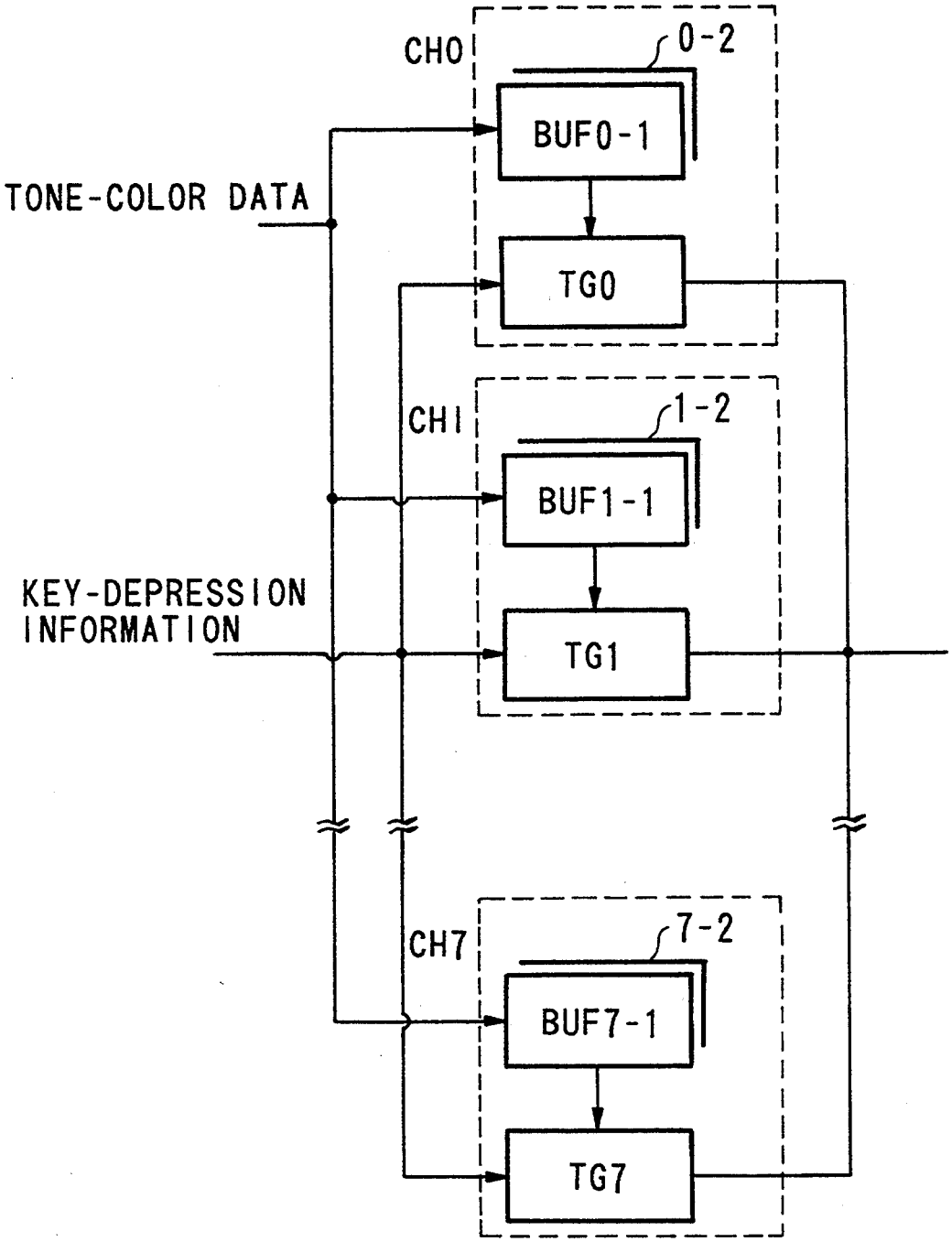
FIG. 3 is a block diagram showing a detailed configuration of a musical tone synthesizing circuit shown in FIG. 1.

15 designates a musical tone synthesizing circuit which produces a musical tone signal under the control of the CPU 12. As shown in FIG. 3, the musical tone synthesizing circuit 15 provides eight tone generators TG0 through TG7. Each of the tone generators TG0 through TG7 is coupled with two buffers BUF0-1, BUF0-2, . . . BUF7-1, BUF7-2. The tone color data each representing the different tone color are written into the buffers, whereas a set of the tone color data is identified by the micro-program. In time present embodiment, one of the buffers of which symbol is added with a suffix "−1" is selectively used prior to the other buffer. Therefore, the buffer BUF0-1 is used prior to the buffer BUF0-2, for example. Further, one tone generator (TG0, . . . TG7) coupled with two buffers (BUF0-1, BUF0-2, . . . BUF7-1, BUF7-2) configure one channel (CH0, . . . CH7).

The musical tone signal produced in each of the generators is supplied to a sound system 16 wherein the musical tone signal is amplified. Then, a speaker 17 produces a musical tone corresponding to an amplified musical tone signal .

20 designates a read-only memory (i.e., ROM) which store several kinds of programs used for the CPU and the tone color data. In the present embodiment, approximately one-hundred kinds of tone colors are stored as the tone color data.

21 designates a random-access memory (i.e., RAM) in which several kinds of registers and Flags are provided and a working area is also provided. Further, there is provided a tone-color assignment buffer 23, of which contents are shown in FIG. 2, in the RAM 21. This tone-color assignment buffer 23 is used for designating the tone color data to be written in the buffers. According to the contents of the tone-color assignment buffer 23 shown in FIG. 2 in connection with the channel CH0, the tone color of the brass instrument (represented by "BRASS") is designated for the buffer BUF0-1 so that the corresponding tone color data is transferred to the buffer BUF0-1, while tone color of the piano (represented by "PIANO") is designated for the buffer BUF0-2 so that the corresponding tone color data is transferred to the buffer BUF0-2.

Next, 25 designates an operation panel on which tone-color select switches and the other kinds of switches are fixed. When operating a certain switch, an operation signal is produced. This operation signal is supplied to the CPU 12 by means of a panel interface 26. When the tone-color select switch is operated, the contents of the tone-color assignment buffer 23 is rewritten in accordance with the operation signal under the control of the CPU 12. In accordance with the rewritten contents of the tone-color assignment buffer 23, the tone color data stored in the ROM 20 are transferred to the buffers BUF0-1, BUF0-2, . . . BUF7-1 , BUF7-2.

[B] Operation of First Embodiment

Next, the operation of the first embodiment will be described in detail.

(1) Main Routine

FIG. 4 is a flowchart showing a main routine. In a first step SP1 of this main routine, an initialization process is carried out so as to initialize several portions of the apparatus. Then, a MIDI process, a panel process and a tone-generation channel process are sequentially performed in steps SP2, SP3 and SP4 respectively. These processes of steps SP2, SP3 and SP4 are repeatedly performed afterwards. In the panel process of step SP3, the CPU 12 scans each of the switches fixed on the operation panel 25 so as to monitor whether each switch is turned on or off. In accordance with the on/- off state of each switch, the tone color and the like are properly set. Since the contents of this panel process is similar to that of the panel process which is carried out in a general electronic musical instrument, the detailed description thereof will be omitted. Thus, several kinds of subroutine programs used in the MIDI process and tone-generation channel process of steps SP2 and SP4 will be described below in detail.

(2) MIDI Process

FIG. 5 is a flowchart showing a subroutine for a MIDI process. In step SPa1, a scanning operation is performed on a MIDI buffer. The MIDI buffer is set In the RAM 21. The MIDI interface 11 is designed to transfer a MIDI signal, given from the external MIDI interface 11, to the MIDI buffer. Then, the processing proceeds to step SPa2 wherein it is judged whether or not a MIDI event is occurred on a manual-operable member on the basis of a result of the aforementioned scanning operation. Herein, the manual-operable member is used to change a performance element, while MIDI event represents a change of the performance element. In the case of the keyboard unit, the MIDI event represents a change of the key of which state is changed From a key-off state to a key-on state or from a key-on state to a key-off state.

If the judgement result of step SPa2 is "NO", the processing directly returns back so that the procedure of this MIDI process is terminated. When the judgement result of step SPa2 turns to "YES", the processing proceeds to step SPa3 wherein the note-on data NON or the note-off data NOFF is written into a register EV with respect to the scanned key in which the MIDI event is occurred. Herein, the note-on data NON represents a change of the key of which state is changed from the key-off state to the key-on state, while the note-off data NOFF represents a change of the key of which state is changed from the key-on state to the key-off state. Further, the note code representing the tone pitch is written into a register NC, while the velocity corresponding to the key-operating velocity is written into a register NV. In next step SPa4, it is judged whether or not the contents of the register EV represents the note-on data NON. If the judgement result of this step SPa4 is "YES", the processing proceeds to step SPa5 representing a note-on process. When the judgement result of step SPa4 turns to "NO", the processing branches to step SPa6 representing a note-off process.

(i) Note-On Process

Figure 6:
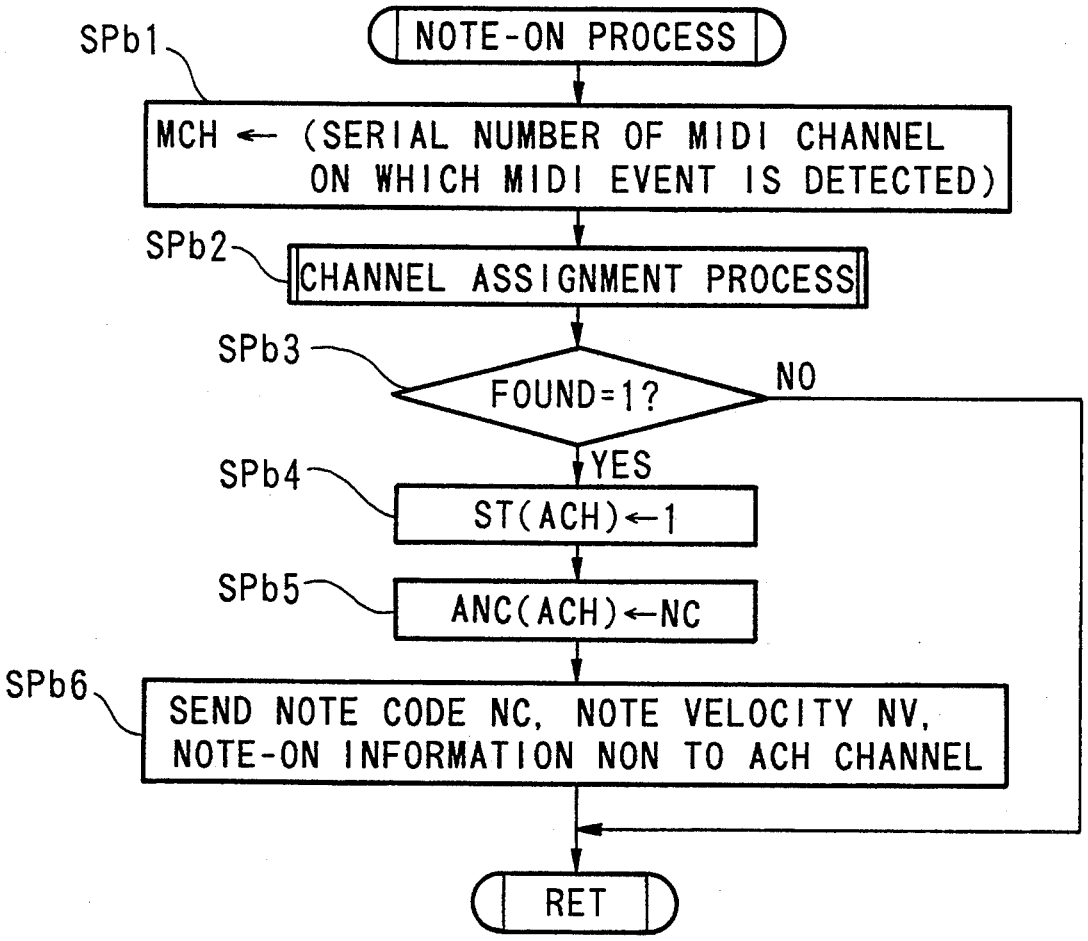
FIG. 6 is a flowchart showing a subroutine for a note-on process.

FIG. 6 is a flowchart showing a subroutine for the note-on process. In first step SPb1, a serial number of a MIDI channel on which the MIDI event is detected is written into a register MCH. Different from the foregoing tone-generation channel (or channel), this MIDI channel is defined as the electronic transmission path or the like connected between the external MIDI device 10 and the MIDI interface 11. Next, the processing proceeds to step SPb2 representing a channel assignment process. In the channel assignment process, a tone-generation task for generating a musical tone on which a note-on event is occurred is assigned to one of the tone generators TG0 through TG7, i.e., one of the channels CH0 through CH7. The details of this process will be described later. When a channel to which the tone-generation task can be assigned is found, a value of a flag FOUND is set at "1". At the same time, the serial number of the channel to be assigned with the tone-generation task is written into a register ACH. When it fails to find out the channel to which the tone-generation task can be assigned, the value of the flag FOUND is cleared to "0".

In step SPb3, it is judged whether or not the value of the flag FOUND is equal to "1". If the judgement result of this step SPb3 is "NO", which can be interpreted that there is no channel to which the tone-generation task can be assigned, the processing returns back without substantially performing the key-on process described below. On the other hand, when the judgement result of step SPb3 turns to "YES", the processing proceeds to step SPb4 wherein a value "1" is written into a register ST(ACH). Herein, a term "(ACH)" represents the contents of the register ACH, i.e. , the serial number of the channel to be assigned with the tone-generation task. The value the register ACH can take one of three values "0", "1"and "2". Herein, "0" indicates an unoccupied channel which is not occupied with the execution of the tone-generation task; "1" indicates the channel corresponding to the depressing key; and "2" indicates the channel corresponding to the released key.

Next, the processing proceeds to step SPb5 wherein a note code stored in the register NC is written into a register ANC(ACH). Then, the processing proceeds to step SPb6 wherein all of the note code of the register NC, the note velocity of the register NV and the note-on information NON are transferred to the channel of which serial number is represented by the value of the register ACH. As a result, the musical tone synthesizing circuit 15 starts to synthesize the musical tone signal in the corresponding channel.

Incidentally, the selection of the buffers BUF(ACH)-1, BUF(ACH)-2 in each of the channels CH0 through CH7 is carried out in the channel assignment process (see step SPb2). The detailed description for such selection of the buffers will be given later.

(ii) Note-Off Process

Figure 7:
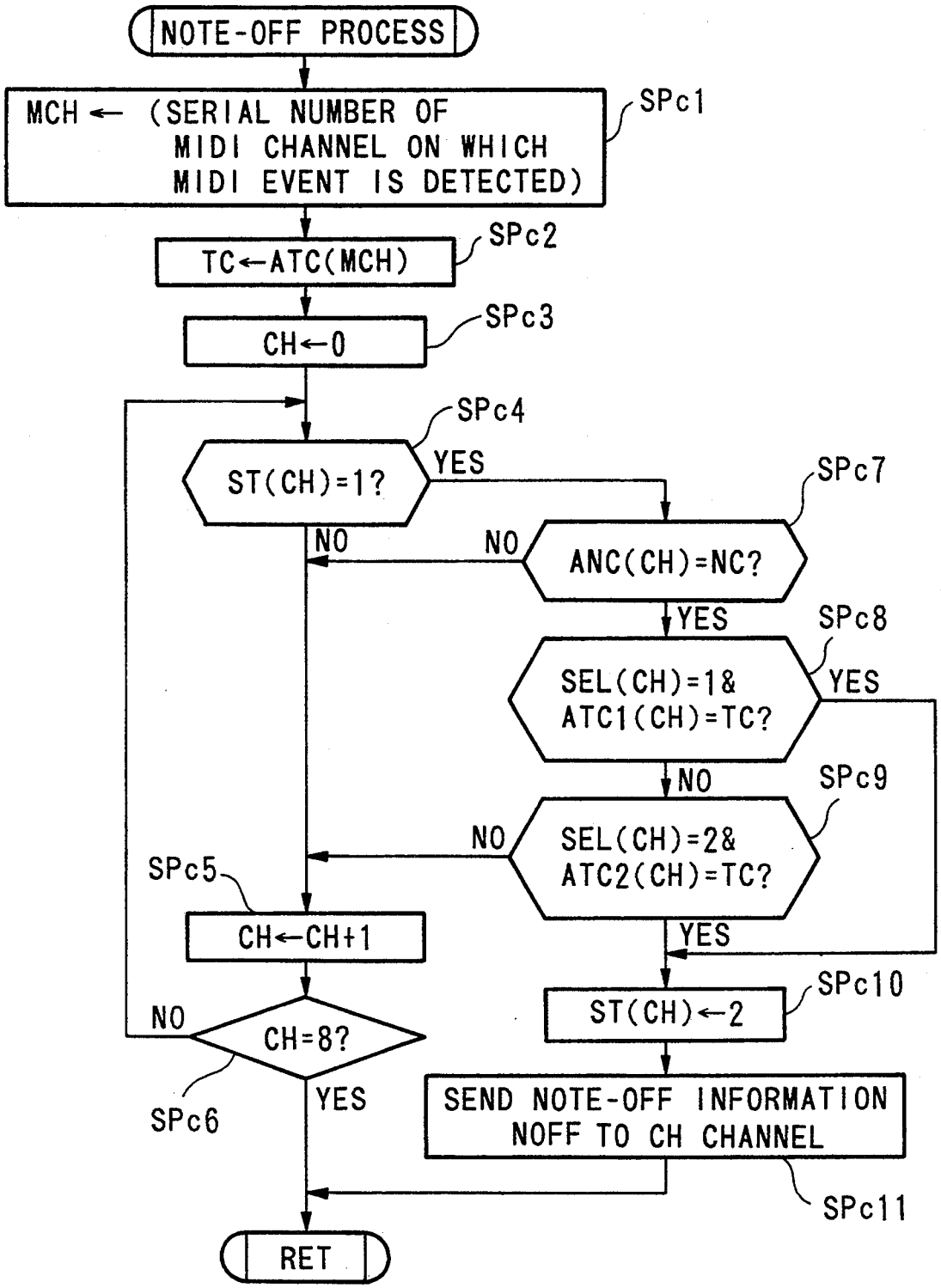
FIG. 7 is a flowchart showing a subroutine for a note-off process.

Next, the contents of the note-off process will be described in detail by referring to FIG. 7. In step SPc1, the serial number of the MIDI channel on which the key-off event is detected is written into the register MCH. In next step SPc2, a value of a register ATC(MCH) is written into a register TC. A tone-color code (representing a specific tone color) corresponding to the serial number of the MIDI channel is stored in the register ATC(0), . . . ATC(7) in advance. For example, a tone-color code representing the tone color of the piano is stored in the register ATC(1), while another tone-color code representing the tone color of the violin is stored in the register ATC(2), for example. In this step SPc2, the tone-color code off the register ATC(MCH) corresponding to the serial number of the MIDI channel on which the MIDI event is occurred is transferred to the register TC.

Next, the processing proceeds to step SPc3 wherein in order to scan and examine each off the states off the channels CH0 through CH7, the contents of the register CH representing a serial number of a currently scanned channel is cleared. In step SPc4, it is judged whether or not a value of a register ST(CH) is equal to "1" In other words, it is judged whether or not a currently scanned key is now depressed. If the judgement result of step SPc4 is "NO", in other words, if the value of the register ST(CH) is equal to "0" (indicating an unoccupied channel) or "2" (indicating a currently released channel), the note-off event has been already occurred with respect to a currently scanned channel, so that the note-off process will not be newly carried out with respect to that channel. Then, the processing proceeds to step SPc5 wherein the serial number of the channel to be currently scanned is incremented by one. In next step SPc6, it is judged whether or not the value of the register CH is equal to "8". In other words, it is judged whether or not the scanning operation is completely carried out with respect to all of the channels. If the judgement result of step SPc6 is "NO", the processing returns back to step SPc4.

On the other hand, if the judgement result of step SPc4 is "YES", the processing branches to step SPc7 wherein it is judged whether or not the value of the register ANC(CH) represents the note code of the key on which the key-off event is occurred. If the judgement result of step SPc7 is "NO", it is proved that the key-off event is occurred on the key which is not currently scanned. In such event, the note-off process is not carried out, and consequently, the processing branches to step SPc5. In step SPc5, the serial number off the currently scanned channel CH incremented by one, and then, the processing returns to step SPc4 via step SPc6 so that the judging process of step SPc4 is carried out again.

When the judgement result of step SPc7 turns to "YES", the processing proceeds to step SPc8 wherein it is judged whether or not a value of a register SEL(CH) is equal to "1" and a value of a register ACT1(CH) coincides with that of the register TC. As described before, the tone-color code is written in the register TC in the foregoing step SPc2. Incidentally, the value of the register SEL(CH) indicates one of the tone colors (or tone color parameters) respectively belonging to a "group-1" and a "group-2" of the table shown in FIG. 2 in connection with the currently scanned channel CH. Further, the register ATC1(CH) is provided to store the tone color belonging to the group-1 of the table with respect to each of the channels.

In the case where the judgement result of step SPc8 is "YES", the musical tone corresponding to the key on which the key-off event is occurred is produced by the tone color belonging to the group-1 of the table in connection with the channel represented by the value off the register CH. In this case, the processing jumps to step SPc10.

In the case where the judgement result of step SPc8 is "NO", the processing proceeds to step SPc9 wherein it is judged whether or not a value of a register SEL(CH) is equal to "2" and a value of a register ATC2(CH) is also equal to the value of the register TC. The function of the register ATC2(CH) is similar to that of the foregoing register ATC1(CH), and this register ATC2(CH) is provided to store the tone color belonging to the group-2 of the table with respect to each of the channels. In the case where the judgement result of step SPc9 is "YES", the musical tone corresponding to the key on which the key-off event is occurred is produced by the tone color belonging to the group-2 of the table in connection with the channel CH. In this case, the processing proceeds to step SPc10. If the judgement result of step SPc9 is "NO", the processing branches to step SPc5 wherein the serial number of the channel indicated by the register CH is incremented by one. Then, the processing returns to step SPc4 via step SPc6, so that the judgement process of step SPc4 is carried out again.

On the other hand, if either the judgement result of step SPc8 or the judgement result of step SPc9 turns to "YES", the processing proceeds to step SPc10 wherein a value "2" representing that the key-release operation is now proceeding is written into the register ST(CH). In next step SPc11, the note-off information NOFF is sent to the channel ell, thus terminating the tone-generation task of the channel CH.

After completing the process of step SPc11, the processing returns back. Incidentally, if the CPU 12 scans all channels but falls to find out the channel on which the note-off operation should be carried out, the judgement result of step SPc8 turns to "YES" so that the processing returns back.

(3) Tone-Generation Channel Process

Figure 8:
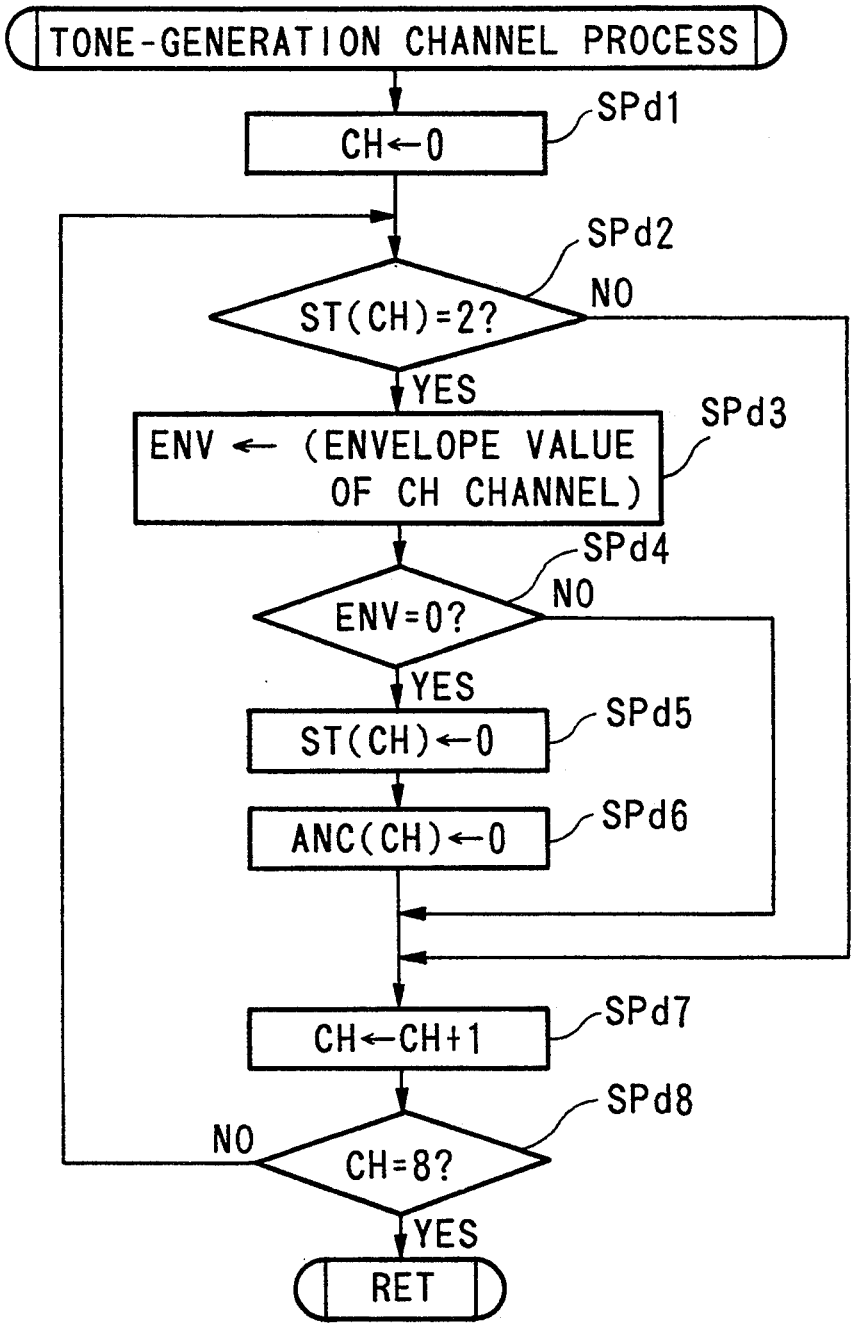
FIG. 8 is a flowchart showing a subroutine for a tone-generation channel process.

Next, the tone-generation channel process will be described in detail by referring to FIG. 8. According to this process, the CPU 12 functions to find out the channel in which the amplitude of the musical tone signal is reduced to zero level so as to set this channel as an unoccupied channel. In order to do so, all of the channels are scanned to search the channel corresponding to the zero-level amplitude of the musical tone signal.

In order to scan all of the channels, the value of the register CH which is now used for counting the number of the channels to be scanned is cleared to zero in step SPd1. In step SPd7, the value of the register CH is incremented by one. In step SPd8, it is judged whether or not all of the channels are scanned by judging whether or not the value of the register CH becomes equal to "8". There is formed a software loop connected between steps SPd2 and SPd8 in the flowchart shown in FIG. 8, by which all of the channels are eventually scanned by the CPU 12.

In step SPd2, it is judged whether or not the value of the register ST(CH) is equal to "2", In other words, it is judged whether or not a key-release event is occurred on a currently scanned channel. In the case where the judgement result of step SPd2 is "NO", the musical tone is now produced from the currently scanned channel and the key-release event is not occurred. In this case, the channel is not set as an unoccupied channel. Thus, the processing jumps to step SPd7 without setting the unoccupied channel. On the other hand, when the judgement result of step SPd2 is "YES", the processing proceeds to step SPd3 wherein an envelope value of the musical tone signal which is produced from the currently scanned channel at a current moment is written into the register ENV. In next step SPd4, it is judged whether or not the written value of the register ENV is equal to "0". In the case where the judgement result of step SPd4 is "NO", the key-release event has been occurred but the channel does not terminate the tone-generation operation, in other words, the channel now proceeds with an attenuation operation of the musical tone signal. In this case, the processing jumps to step SPd7 without setting the channel as an unoccupied channel.

If the judgement result of step SPd4 is "YES", the processing proceeds to step SPd5 wherein a value "0"representing the unoccupied channel is written into the register ST(CH) representing the state of the channel. In next step SPd6, a value "0" is written into the register ANC(CH) which is provided to store the note code. This value "0" does not correspond to the note code, in other words, this value is an invalid value. Then, the processing proceeds to step SPd7.

After completing the above-mentioned processes of steps SPd2 through SPd7 on all of the channels, the processing returns back to the main routine via step SPd5.

(4) Channel Assignment Process

Next, the channel assignment process will be described in detail by referring to FIG. 9. In the channel assignment process, the tone-generation task for the musical note corresponding to the key on which the key-on event is occurred is assigned to the unoccupied channel. If the CPU 12 fails to find out the unoccupied channel, the CPU 12 carries out a truncate process which will be described later. This channel assignment process is derived from the aforementioned note-on process (see step SPb2 in FIG. 6).

Figure 9:
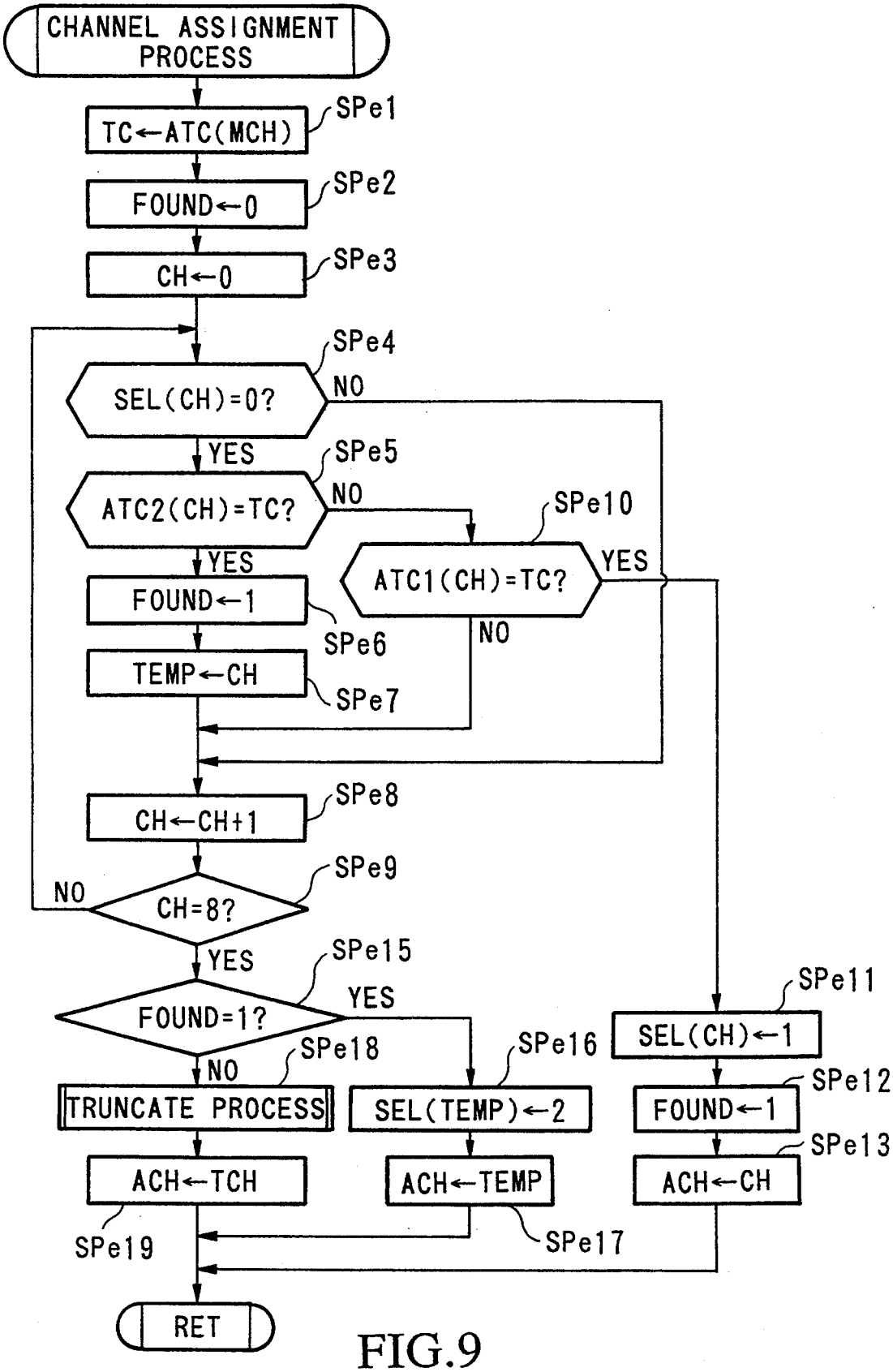
FIG. 9 is a flowchart showing a subroutine for a channel assignment process.

In step SPe1 of FIG. 9, the value of the register ATC(MCH) is transferred to the register TC. Herein, the value of the register MCH represents the serial number of the MIDI channel on which the MIDI event is detected in the note-on process (see step SPb1 in FIG. 6). By the process of step SPe1, the tone-color code corresponding to the serial number of the MIDI channel on which the MIDI event is occurred is transferred to the register TC.

In step SPe2, a flag FOUND is cleared. This flag FOUND represents whether or not the unoccupied channel is found. In the channel assignment process, all of the channels are scanned and examined. More specifically, the value of the register CH which is used for counting the number off the channels to be scanned is cleared to zero in step SPe3; the value of the register CH is incremented by one in step SPe8; and then, it is judged whether or not all of the channels are scanned by judging whether or not the value of the register CH becomes equal to "8" in step SPe9. Therefore, in the normal state except for the case where the optimum tone-generation channel is found, the software loop connected between steps SPe4 and SPe9 is repeatedly executed.

In step SPe4, it is judged whether or not the value of the register ST(CH) representing the tone-generation state of the channel is equal to "0", in other words, it is judged whether or not the currently scanned channel the unoccupied channel. If the judgement result of step SPe4 is "NO", the processing returns back to step SPe4 via steps SPe8 and SPe9 because the channel assignment operation cannot be performed on the currently scanned channel.

On the other hand, when the judgement result of step SPe4 turns to "YES", the processing proceeds to step SPe5 wherein it is judged whether or not the tone-color code stored in the register ATC2(CH) is identical to the tone-color code stored in the register TC. In other words, it is judged whether or not the tone color belonging to the group-2 of the table (see FIG. 2) in connection with the currently scanned channel is identical to the tone color assigned to the key on which the key-on event is occurred. If the judgement result of step SPe5 is "NO", the processing jumps to step SPe10 wherein it is judged whether or not the tone color belonging to the group-1 of the table in connection with the currently scanned channel is identical to the tone color assigned to the key on which the key-on event is occurred. When the judgement result of step SPe10 turns to "YES", processes of steps SPe11 through SPe13 are carried out so as to assign the tone color to the channel. More specifically, in step SPe11, the value of the register SEL(CH) is set at "1" so as to declare that the group-1 tone color is selected. In step SPe12, the value of the flag FOUND is set at "1" so as to declare that the unoccupied channel is found. In step SPe13, the value of the register CH representing the serial number of the unoccupied channel is written into the register ACH. On the basis of the values of the registers SEL(CH) and ACH, a group-1 buffer, i.e., buffer BUF(ACH)-1 is selected for the channel designated by the value of the register ACH. After completing the process of step SPe13, the processing returns back to the foregoing note-on process shown in FIG. 6, so that the musical tone is produced by the processes of steps SPb4, SPb5 and SPb6.

On the other hand, when both of the judgement results of steps SPe5 and SPe10 denote a negative decision "NO", the unoccupied channel cannot be found with respect to both of the group-1 tone color and the group-2 tone color. In this case, the processing returns to step SPe4 via steps SPe8 and SPe9, so that the processings are carried out on the next scanned channel.

In the case where the .judgement result of step SPe5 is "YES", the unoccupied channel can be found with respect to the group-2 tone color. Therefore, the processing proceeds to step SPe6 wherein the value of the flag FOUND is set at "1". In next step SPe7, the value of the register CH representing the serial number of that channel is transferred to a register TEMP. This register TEMP is provided to temporarily store the serial number of the unoccupied channel which is found with respect to the group-2 tone color.

After completing the process of step SPe7, the processing returns to step SPe4 via steps SPe8 and SPe9. Thereafter, the above-mentioned processes are carried out until the scanned channel reaches the channel CH7. In the case where the unoccupied channel is found with respect to the group-1 tone color, the processes of steps SPe10 through SPe13 are carried out and then the processing returns back to the foregoing note-on process so that the tone-generation operation will be carried out. In short, when the unoccupied channel is found with respect to the group-1 tone color, the CPU 12 immediately performs the channel assignment operation and then performs the tone-generation operation. Thus, the channel assignment operation in connection with the group-1 tone color is firstly carried out prior to the other operations.

Next, when the CPU 12 fails to find out the unoccupied channel with respect to the group-1 tone color but the CPU 12 certainly finds out the unoccupied channel with respect to the group-2 tone color, the processing proceeds to step SPe16 via steps SPe9 and SPe15. In step SPe16, a value of a register SEL(TEMP) is set at "2" representing that the group-2 tone color is selected. In next step SPe17, the value of the register TEMP representing the serial number of the unoccupied channel found by the CPU 12 is written into the register ACH. On the basis of the values of the registers SEL(CH) and ACH, the group-2 buffer, i.e., buffer BUF(ACH)-2, is selected for the channel designated by the register ACH. After completing the process of step SPe17, the processing returns back to the foregoing note-on process as shown in FIG. 6 so that the musical tone will be produced.

In contrast, when the CPU 12 falls to find out any unoccupied channels with respect to both of the group-1 tone color and group-2 tone color, the processing proceeds to step SPe18 via steps SPe9 and SPe15. In step SPe18, the truncate process is carried out. According to the truncate process, the CPU 12 tries to find out the channel which is now proceeding with the tone generation but of which envelope value of the musical tone signal is the smallest (in other words, of which tone volume of the musical tone is the lowest), and then, the channel forced to be set as an unoccupied channel to which a new tone-generation task is assigned. The details of the truncate process will be described later. The serial number of the unoccupied channel which is set by the truncate process is written into the register TCH.

In step SPe19, the value of the register TCH is written into the register ACH. Thereafter, the processing returns back to the note-on process shown in FIG. 6 so that the musical tone will be produced.

(i) Truncate Process

Next, the truncate process will be described in detail by referring to FIGS. 10 and 11.

Figure 10:
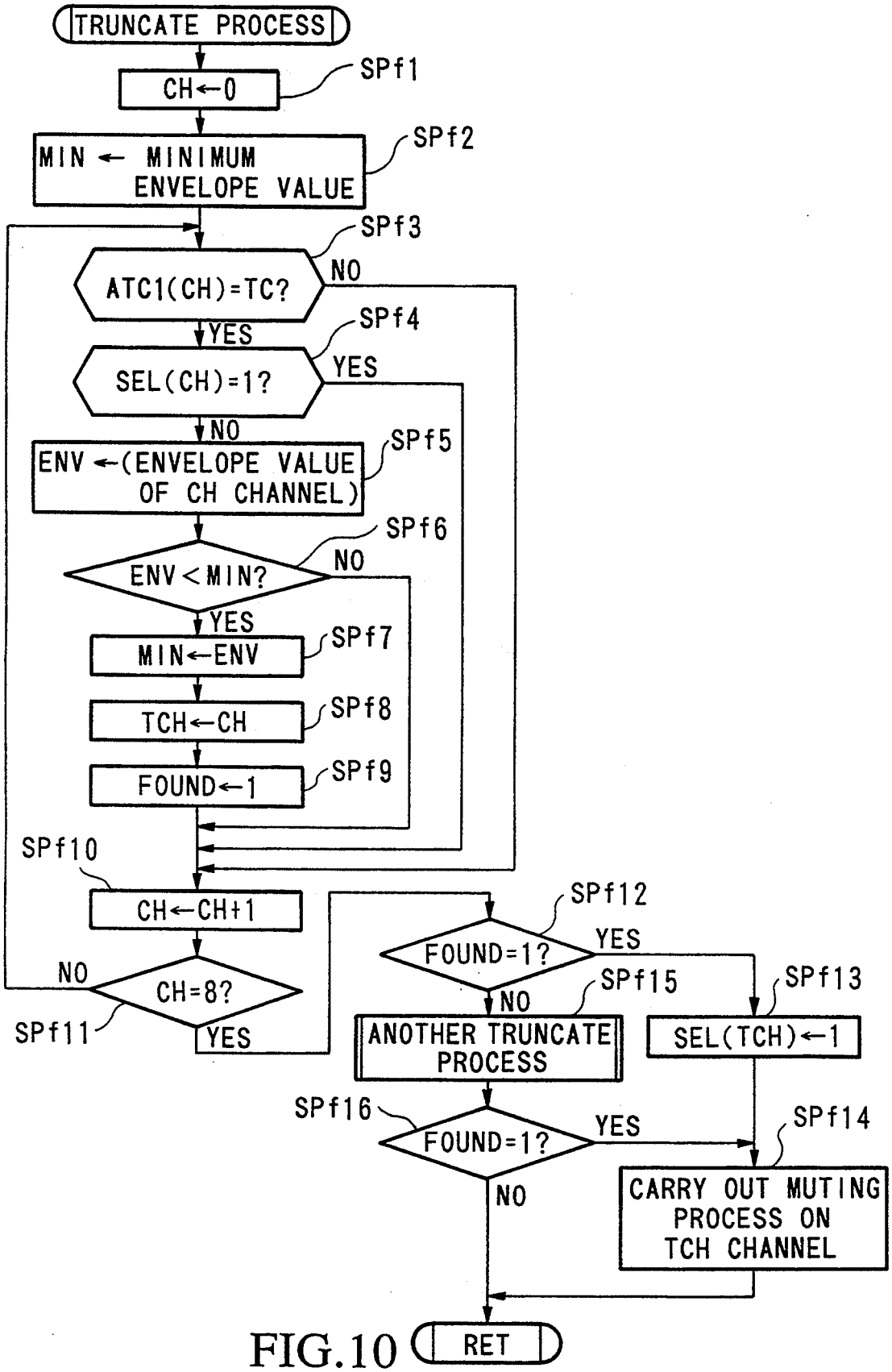
FIG. 10 is a flowchart showing a subroutine for a truncate process.

According to the processes of the flowchart shown in FIG. 10, when the group-1 tone color is set for the musical note on which the note-on event is occurred, the channel of which envelope value is the smallest is selected from the channels which are now proceeding with the tone-generation operations by use of the group-2 tone colors at a current moment, so that a new tone-generation task is assigned to it.

In first step SPf1 in FIG. 10, in order to scan all of the channels, the register CH is cleared. In next step SPf2, the minimum value of the envelope is written into a register MIN. This register MIN is provided to search the minimum envelope value. In order to do so, the minimum value of the envelope stored in the register MIN is compared to the envelope value of each channel. When the envelope value of a certain channel is found to be smaller than the minimum value of the envelope stored in the register MIN, the stored value of the register MIN is replaced by such envelope value.

In step SPf3, it is judged whether or not the tone-color code (i.e., tone color of the musical note on which the note-on event is occurred) stored in the register TC coincides with the tone-color code stored in the register ATC1(CH). In other words, it is judged whether or not the tone-color code represents the group-1 tone color which is set for the channel CH. If the judgement result of step SPf3 is "YES", the processing proceeds to step SPf4 wherein it is judged whether or not the value of the register SEL(CH) is equal to "1". By this judging process of step SPf4, it is judged whether or not the currently scanned channel is now proceeding with the tone-generation operation by use of the group-1 tone color. When the judgement result of step SPf4 to "NO", the processing proceeds to step SPf5 wherein the envelope value of the current channel is written into the register ENV. In next step SPf6, it is judged whether or not the value of the register ENV is smaller than the value of the register MIN. If the judgement result of step SPf6 is "YES", the processing proceeds to step SPf7 wherein the value off the register ENV is written into the register MIN. In step SPf8, the value of the register CH representing the serial number of the current channel is written into a register TCH. The register TCH is provided to store the serial number of the channel which is forced to be assigned with a new tone-generation task (hereinafter, simply referred to as a truncate channel). In step SPf9, the value of the flag FOUND is set at "1" so as to declare that the unoccupied channel is detected.

After completing the process of step SPf9, the processing proceeds to step SPf10 wherein the value of the register CH is incremented by one. In next step SPf11, it is judged whether or not all of the channels are scanned. If the CPU 12 does not completely scan all of the channels, the processing returns to step SPf3, so that the above-mentioned processes will be repeated.

While repeating the above-mentioned processes, the values of the registers MIN and TCH are rewritten when the CPU 12 finds out the channel of which envelope value is smaller than the previously stored envelope value. However, if such channel is not found, the previously stored envelope value is remained as it is (see a branching path from step SPf6 to step SPf10).

Meanwhile, when the judgement result of step SPf3 turns to "NO", it is detected that the tone color of the musical note corresponding to the note-on event does not coincide with the group-1 tone color which is determined in advance with respect to the channel CH. In this case, the processing immediately returns so as to carry out the processing on the next channel without carrying out the truncate process on the current channel (see a branching path from step SPf4 to step SPf10). When the judgement result of step SPf4 turns to "YES", it is detected that the current channel CH functions to produce a musical tone having the group-1 tone color (which is selected prior to the group-2 tone color). At this time, a new tone-generation task is not assigned to the channel CH, and then, the CPU 12 proceeds with the next channel.

In the meantime, when the truncate channel is detected by the above-mentioned processes, the processing proceeds to step SPf13 via steps SPf11 and SPf12, In step SPf13, the value of the register SEL(TCH) is rewritten by "1", because the tone-generation operation was carried out by use of the group-2 tone color until then. In next step SPf14, a muting process is forced to be carried out on the channel designated by the register TCH. Thereafter, the processing returns back to the flowchart shown in FIG. 9, so that the processing proceeds from step SPe18 to step SPe19. After completing the process of step SPe19, the processing returns back to the note-on process shown in FIG. 6, so that the musical tone corresponding to the note-on event is sounded (see steps SPb3 through SPb6 in FIG. 6).

In the case where the truncate channel is not detected in the software loop consisting of steps SPf3 through SPf11, the processing proceeds to step SPf15 via steps SPf11 and SPf12. In step SPf15, another truncate process is carried out.

Figure 11:
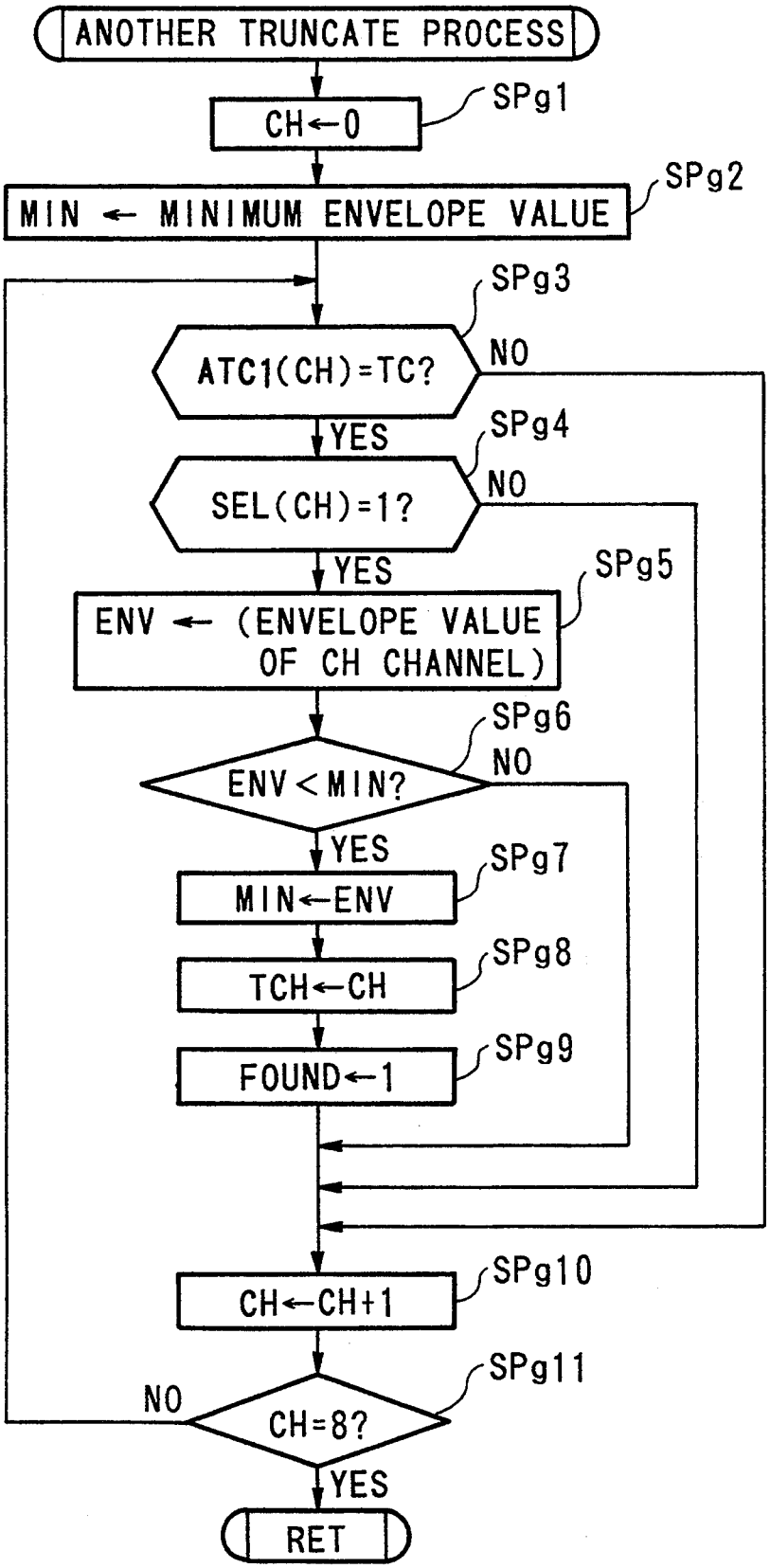
FIG. 11 is a flowchart showing a subroutine for another truncate process.

The details of another truncate process are shown in FIG. 11. Roughly all of the processes contained in another truncate process as shown in FIG. 11 are similar to steps SPf1 through SPf11 of the foregoing truncate process as shown in FIG. 10, except for a process of step SPg4.

The decision branchings (i.e., locations of "YES" and "NO" of the decision symbol) of step SPg4 shown in FIG. 11 are reverse to those of step SPf4 shown in FIG. 10. By the process off step SPg4, the truncate process is carried out when the current channel functions to produce a musical tone by use of the group-1 tone color.

Therefore, under the processes off FIG. 11, the channel of which envelope value is the smallest among the channels which function to produce the musical tones by use of the group-1 tone colors is detected as the truncate channel.

After completing the processes of FIG. 11, the processing returns to the truncate process shown in FIG. 10 wherein the processing further proceeds from step SPf15 to step SPf16. In step SPf16, it is judged whether or not the flag FOUND is set at "1". If the judgement result of step SPf16 is "YES", the processing returns back to the channel assignment process shown in FIG. 9 via step SPf14. Then, the processing returns back to the note-on process shown in FIG. 6 via step SPe19, so that the musical tone corresponding to the note-on event is produced (see steps SPb3 through SPb6).

On the other hand, when the judgement result of step SPf16 turns to "NO", in other words, when the truncate channel is not detected, the processing returns back to the note-on process shown in FIG. 6 by means of the channel assignment process shown in FIG. 9. In this case, however, the judgement result of step SPb3 should be "NO", so that the processes of steps SPb4 through SPb6 (which represent the tone-generation operation) are neglected.

[C] Summary of Operation of First Embodiment

As described heretofore, when assigning a new tone-generation task to the unoccupied channel, the group-1 tone color is selected prior to the group-2 tone color, while even in the truncate process, the channel which proceeds with the tone-generation operation by use of the group-1 tone color is not basically selected as the unoccupied channel.

Therefore, the tone colors which are musically important or which are frequently used are classified as the group-1 tone colors. Thus, it is possible to playback the musical tones which are sounded naturally and quite similar to the musical sounds produced from the non-electronic musical instruments to be played.

[D] Configuration of Second Embodiment

Next, a second embodiment of the present invention will be described in detail.

Figure 12:
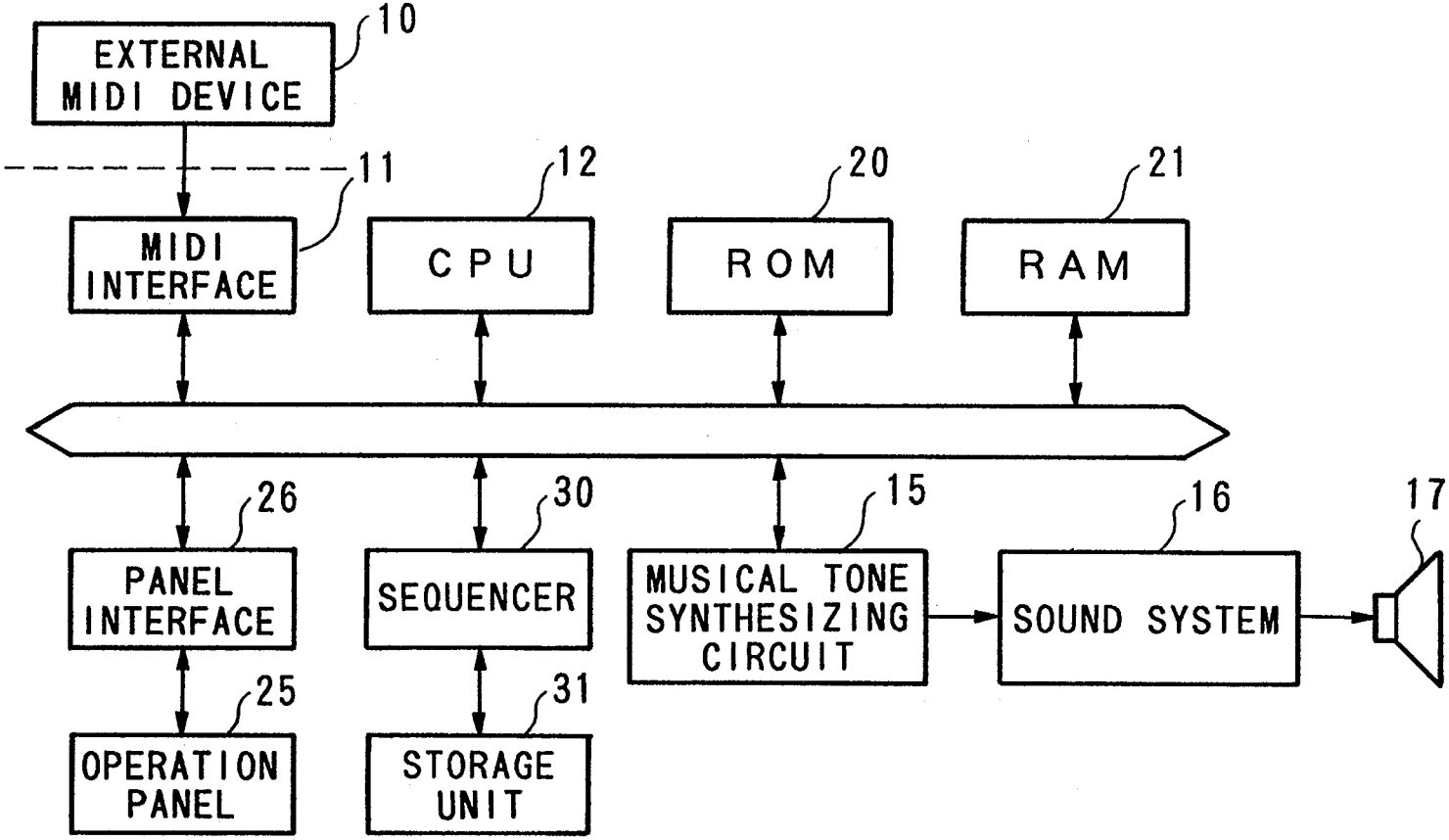
FIG. 12 is a block diagram showing an electronic configuration of the musical tone generating apparatus according to a second embodiment of the present invention.

FIG. 12 is a block diagram showing the electronic configuration of the musical tone generating apparatus according to a second embodiment of the present invention. In FIG. 12, parts identical to those shown in FIG. 1 will be designated by the same numerals, hence, description thereof will be omitted.

Different from the foregoing first embodiment shown in FIG. 1, the second embodiment provides a sequencer unit 30 and a storage unit 31. The storage unit is a floppy-disk unit into which a floppy disk is to be inserted, for example. The floppy disk stores the musical tone information in accordance with a progress of the tune to be performed. The sequencer unit 30 reads out the musical tone information from the floppy disk in the storage unit 31, so that an automatic performance is played in response to the read musical tone information.

[E] Operation of Second Embodiment

Next, the operations of the second embodiment will be described below.

(1) Common Operations

The second embodiment is designed to also carry out the foregoing processes of the first embodiment as shown by FIG. 3 through FIG. 11, hence, description thereof will be omitted. Therefore, the detailed description will be only given with respect to special operations of the second embodiment which relate to the control operation of the sequencer unit 30.

(2) Panel Process

Figure 13:
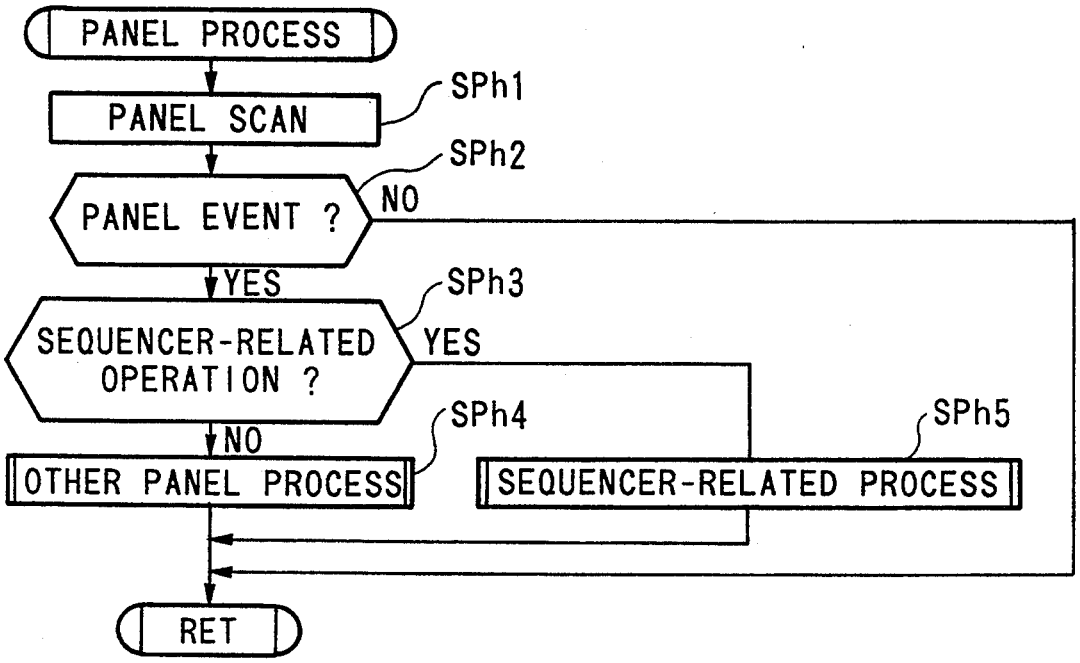
FIG. 13 is a flowchart showing a subroutine for a panel process used in the second embodiment.

FIG. 13 is a flowchart showing a subroutine for the panel process which is exclusively provided for the second embodiment. In first step SPh1, the CPU 12 scans the states of several kinds of switches fixed on the operation panel 25. In step SPh2, it is judged whether or not a panel event is occurred on the operation panel 25. In other words, it is judged whether or not a state of any one of the switches is changed on the operation panel 25. If the judgement result of step SPh2 is "NO", the processing of the CPU 12 returns back without substantially performing any processes in this subroutine. On the other hand, when the judgement result of step SPh2 turns to "YES", the processing proceeds to step SPh3 wherein it is judged whether or not the panel event designates a sequencer-related process. If the judgement result of step SPh3 is "NO", the processing proceeds to step SPh4 wherein other panel processes are to be carried out. When the judgement result of step SPh3 turns to "YES", the processing branches to step SPh5 wherein a sequencer-related process is carried out.

(3) Sequencer-Related Process

Figure 14:
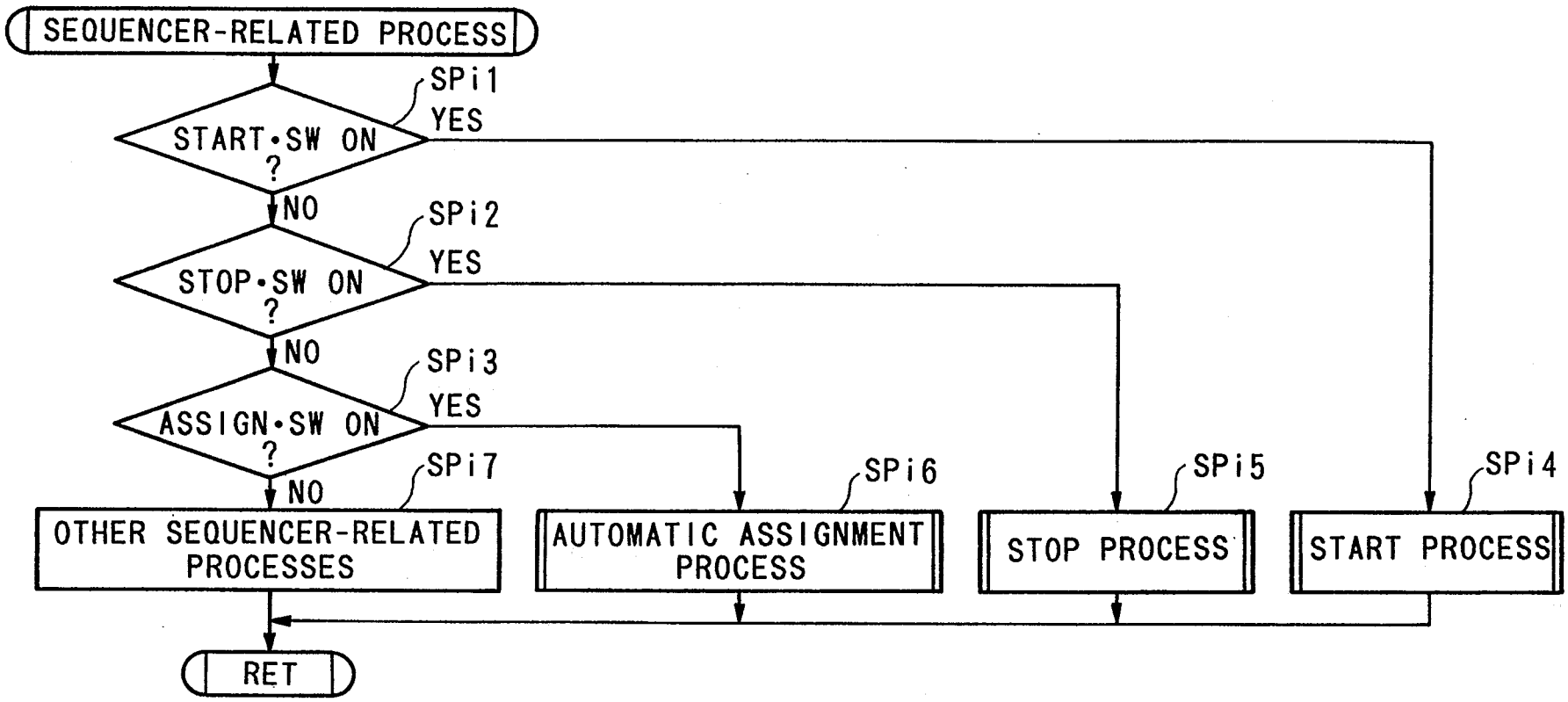
FIG. 14 is a flowchart showing a subroutine for a sequence-related process.

FIG. 14 shows a subroutine for the sequencer-related process. In each of steps SPi1 through SPi3, a judgement process is carried out on a start switch, a stop switch or an assign switch. When it is detected that the corresponding switch is turned on, the judgement result turns to "YES". More specifically, when the start switch is turned on, the processing branches to step SPi4 designating a start process; when the stop switch is turned on, the processing branches to step SPi5 designating a stop process; and when the assign switch is turned on, the processing branches to step SPi6 designating an automatic assignment process. The details of these processes will be described later.

If all of the judgement results of steps SPi1 through SPi3 designate the same negative decision "NO", the processing proceeds to step SPi7 wherein other sequencer-related processes (e.g., a process for entering data into the sequencer unit) are carried out.

(i) Start Process

Figure 15:
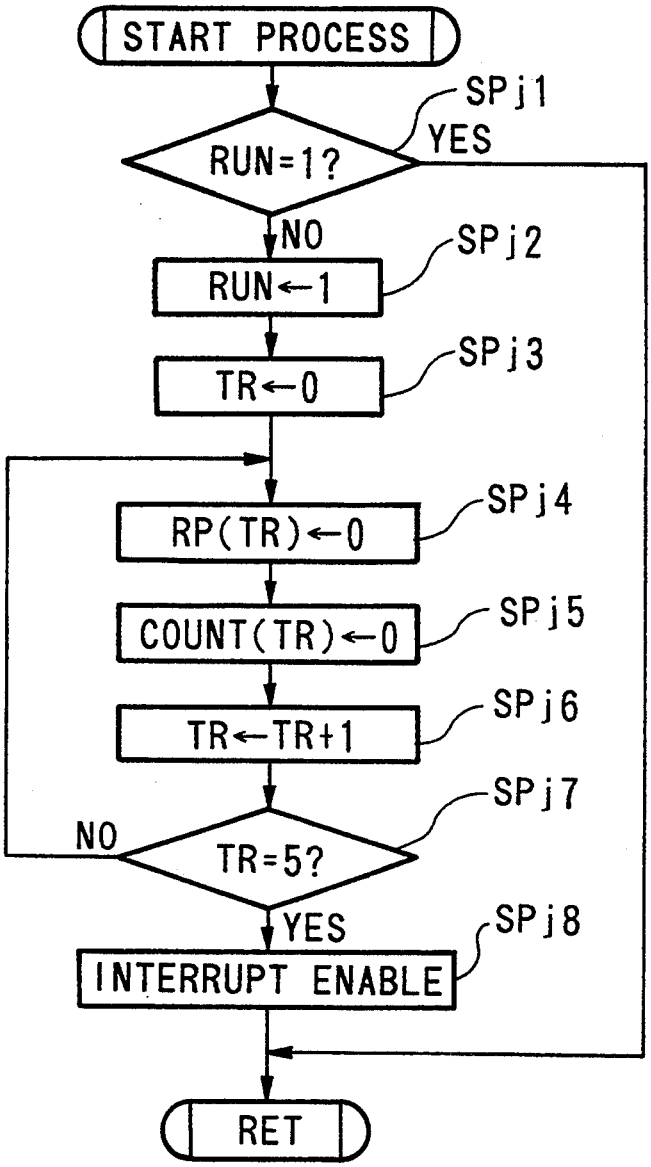
FIG. 15 is a flowchart showing a subroutine for a start process.

FIG. 15 is a flowchart showing a subroutine for the start process. This start process is provided to carry out an initialization for the automatic performance.

In first step SPj1, it is judged whether or not a flag RUN is set at "1". This flag RUN is set at "1" when the sequencer unit 30 is carrying out a process of automatic performance. If the judgement result of step SPj1 is "NO", the processing proceeds to step SPj2 wherein the flag RUN is set at "1". On the other hand, if the judgement result is "YES", the processing directly returns back without substantially performing any processes of this subroutine. The process of step SPj1 is provided to prevent the start process from being carried out twice or more even when the start switch is turned on twice or more.

In step SPj3, a register TR which is used for designating a track of the sequencer is cleared to zero. In the second embodiment, there are provided five tracks in the sequencer. Each of the tracks corresponds to each of the MIDI channels.

In step SPj4, a value "0" is written into a register RP(TR). The register RP(TR) is provided for each track, and this register is used to indicate a read-out point on the corresponding track. Each register RP(TR) is set at "0" at a start timing of the automatic performance. In order to carry out the read-out operation from head data of each track, the register RP(TR) is reset in step SPj4. In next step SPj5, a counter COUNT(TR) is reset to zero. This counter COUNT(TR) is provided to measure (or count) an interval between two events (e.g., time interval between two pieces of musical tone information to be sequentially created). The second embodiment employs an event-read-out system, so that an interval between the events should be measured by each track. For this reason, the counter COUNT(TR) is provided for each of the tracks.

in step SPj6, the value of the register TR is incremented by one. In step SPj7, it is judged whether or not the initializing processes of steps SPj4 through SPj6 are completely carried out with respect to all of the tracks. If the judgement result of step SPj7 is "NO", the processing returns to step SPj4. Thus, the processes of step SPj4 through SPj7 are repeatedly carried out until the initializing processes of steps SPj4 through SPj6 are completely carried out with respect to all of the tracks.

When it is detected that the above-mentioned initializing processes are completely carried out with respect to five tracks respectively assigned with track numbers "0", "1", "2", "3" and "4", the judgement result of step Spj7 turns to "YES" so that the processing proceeds to step SPj8 wherein an interrupt enable process is carried out, The operation of the sequencer is progressed by an interrupt event caused by a timer (not shown). When the process of step SPj8 is started, the operation of the sequencer is started.

The aforementioned counter COUNT(TR) eventually stores a time interval between a current event and a next event when the current event is read out by the sequencer. Every time an interrupt process is caused, the counter counts down its value. When the count value becomes equal to zero, the next event data is read out. The details of this operation will be described later.

(ii) Stop Process

Figure 16:
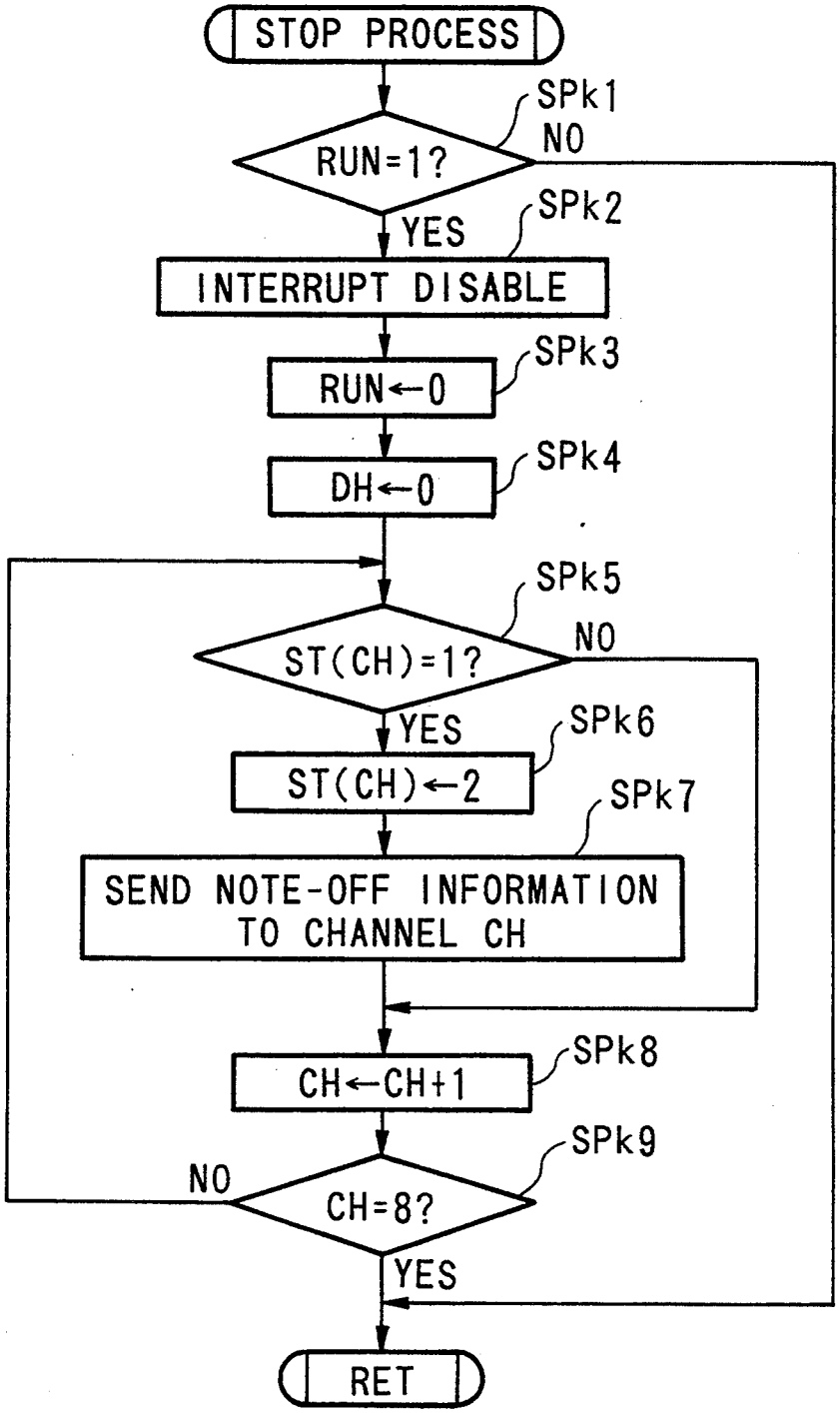
FIG. 16 is a flowchart showing a subroutine for a stop process.

FIG. 16 is a flowchart showing the contents of the stop process. This stop process is provided to end the automatic performance.

In first step SPk1, it is judged whether or not the flag RUN is set at "1". When the judgement result of step SPk1 is "YES", the interrupt process is prohibited in step SPk2, and then, the flag RUN is reset to zero in step SPk3. If the judgement result of step SPk1 is "NO", the processing returns back without substantially carrying out any processes of this subroutine. In short, the judgement process of step SPk1 is provided to prevent the stop process from being carried out twice or more even when the stop switch is turned on twice or more. Further, the process of step SPk2 is provided to prohibit the interrupt process from being carried out so that the operation of the sequencer unit 30 will be stopped.

By processes of steps SPk5 through SPk7, a value "2" representing a muting operation is set to a register ST(CH) with respect to the channel which is now occupied with the tone-generation task. Then, note-off information is sent to that channel so as to stop producing the musical tone signal. By processes of steps SPk4, SPk8 and SPk9, the above-mentioned muting operation is carried out with respect to all of the channels.

(iii) Interrupt Process

Figure 17:
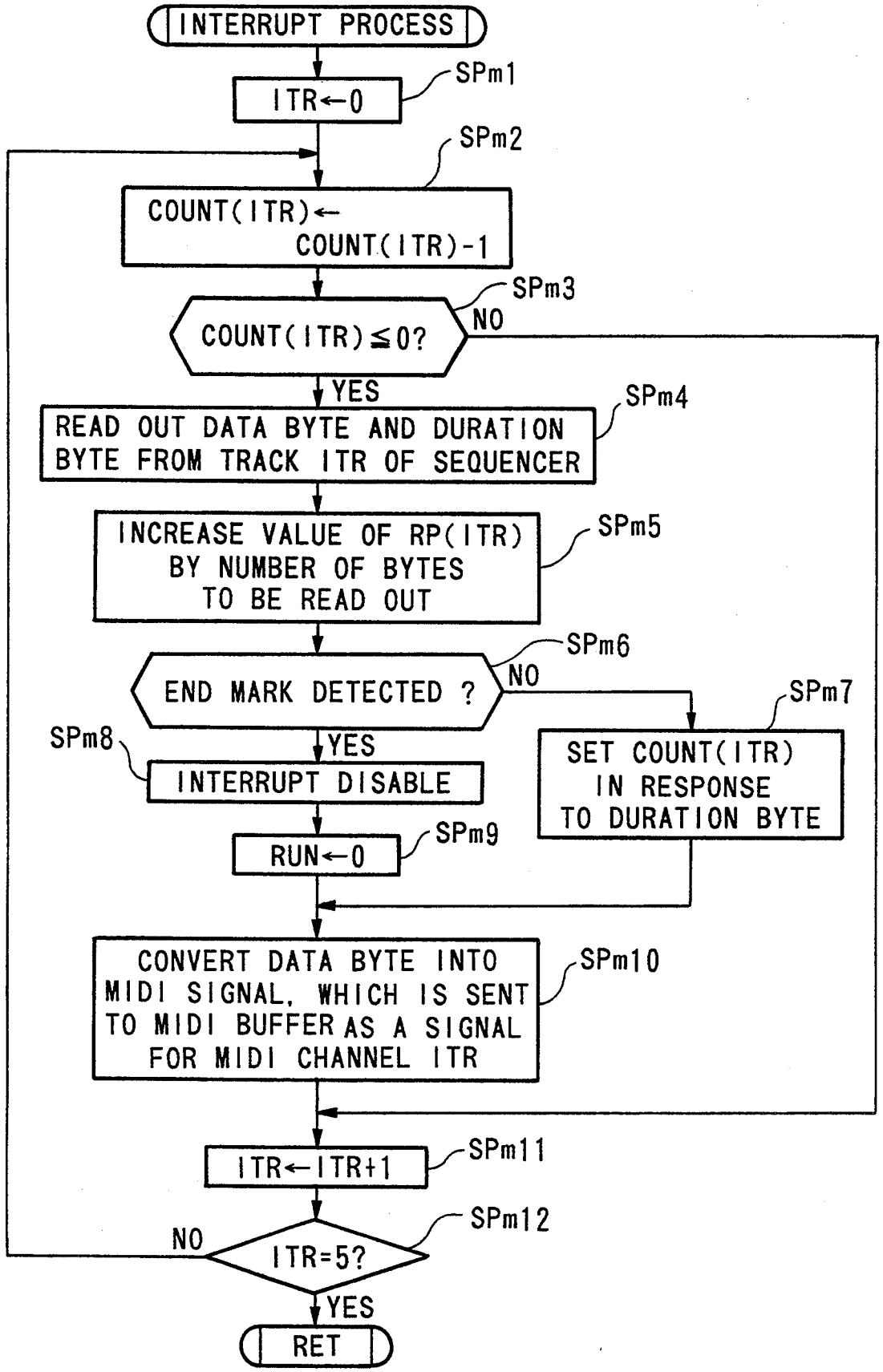
FIG. 17 is a flowchart showing a subroutine for an interrupt process.

FIG. 17 is a flowchart showing the contents of the interrupt process. Every time the timer sends out an interrupt signal, the subroutine of the interrupt process is started to be carried out with respect to each of the tracks of the sequencer.

In first step SPm1, a register ITR which is used for counting a number of the tracks is cleared to zero. In step SPm2, a value of the counter COUNT(ITR) is decremented by one. In step SPm3, it is judged whether or not the count value of the counter COUNT(ITR) becomes equal to "0". If the judgement result of step SPm3 is "YES", the processing proceeds to step SPm4 so as to read out event data. When the judgement result is "NO", it is not a timing to read out the event data. In this case, the processing branches to step SPm11 wherein the value of the register ITR is incremented by one. Then, the processing returns to step SPm2 via step SPm12.

In the read-out process of step SPm4, a data byte (representing the musical tone information) and a duration byte (representing a time interval for the next event) are read from the track designated by the value of the register ITR. In response to the number of bytes to be read out, the value of the register RP(TR), which is used as a pointer, is increased in step SPm5. In step SPm6, it is judged whether or not the read data represents an end mark. The end mark indicates an end point of the automatic performance data. Therefore, the end mark is provided in the last duration byte which is lastly attached to the automatic performance data.

If the judgement result of step SPm6 is "YES", it is necessary to stop the automatic performance. For this reason, the timer interrupt process is prohibited in step SPm8, and then, the flag RUN is reset in step SPm9. On the other hand, if the judgement result of step SPm6 is "NO", the value of the counter COUNT(ITR) is set in response to the value of the duration byte in step SPm7.

After completing the process of step SPm7 or SPm9, the processing proceeds to step SPm10 wherein the data byte (representing the musical tone information) is converted into a MIDI signal, and this MIDI signal is sent to the MIDI buffer as a signal used for the MIDI channel off which serial number is designated by the register ITR. In step SPm11, the register ITR is incremented by one. In step STm12, it is judged whether or not the aforementioned processes of steps SPm2 through SPm10 are carried out with respect to all of the tracks. If the judgement result is "NO", the processes of steps SPm2 through SPm11 are repeatedly carried out. If the judgement result is "YES", the processing returns back.

(iv) Automatic Assignment Process

Figure 18:
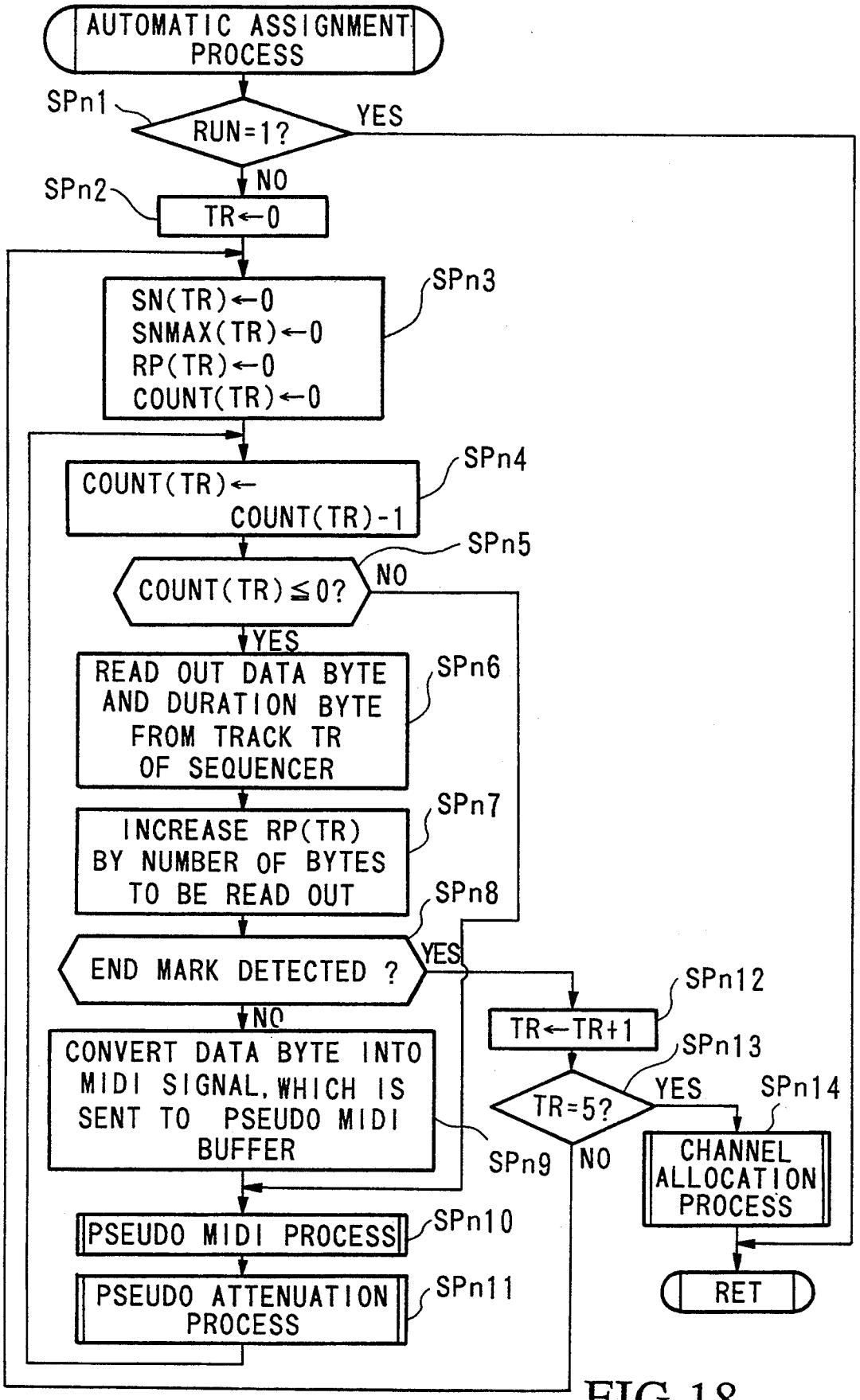
FIG. 18 is a flowchart showing a subroutine for an automatic assignment process.

Next, the automatic assignment process will be described in detail by referring to FIG. 18. This process functions to automatically form the foregoing table as shown in FIG. 2. The subroutine of the automatic assignment process as shown in FIG. 18 further contains three processes, i.e., a pseudo MIDI process shown in FIG. 19, a pseudo attenuation process shown in FIG. 23 and a channel allocation process shown in FIG. 24.

in first step SPn1, it is judged whether or not the flag RUN is set at "1". If the judgement result is "YES", the processing returns back without substantially carrying out any processes of this subroutine. In other words, the automatic assignment process is prohibited. Because, when the automatic assignment process is carried out during the automatic performance is playing, the tone-color data to be transferred to each of the buffers BUF0-1, BUF0-2, . . . BUF7-1, BUF7-2 should be altered, which may cause a malfunction in the operation of the CPU 12.

Next, the register TR which is used for counting the number of the tracks is cleared to zero in step SPn2. In step SPn3, certain registers are cleared to zero. Among thee registers, a register SN(TR) stores a number of the musical tones which are simultaneously sounded with respect to each of the tracks. In the following steps, the musical tone information is read out from each of the tracks in turns. Every time the musical tone information is read out, the number of the musical tones which are simultaneously sounding is written into the register SN(TR). Further, another register SNMAX(TR) will eventually store the maximum value among the values stored in the register SN(TR). Incidentally, the other registers RP and COUNT have been already described before.

In step SPn4, the value of the register COUNT(TR) is decremented by one. In step SPn5, it is judged whether or not the value of the register COUNT(TR) is equal to "0". If the judgement result of step SPn5 is "NO", the operation to read out the event data is not carried out so that the processing immediately jumps to step SPn10. On the other hand, when the judgement result turns to "YES", the processing proceeds to step SPn6 wherein the data byte and the duration byte are read out, and then, the value of the duration byte is set to the register RP(TR). In step SPn7, the value of the register RP(TR) is increased by the number of bytes which are read out in step SPn6. In step SPn8, it is judged whether or not the read data indicates the end mark. If the judgement result of step SPn8 is "YES", it is proved that all pieces of the musical tone information are completely read out with respect to the currently accessed track. Then, the processing branches to step SPn12 wherein the value of the register TR representing the serial number of the track to be accessed is incremented by one. Thereafter, the processing returns to step SPn4 via steps SPn13 and SPn3. Incidentally, a judgement process of step SPn13 is provided to judge whether or not the aforementioned processes of steps through SPn8 and SPn12 are completely carried out with respect to all of the tracks. When the judgement result of step SPn13 turns to "YES", the processing proceeds to step SPn14 representing the channel allocation process, and then, the processing returns back.

On the other hand, if the read data does not indicate the end mark, the processing proceeds from step SPn8 to step SPn9 wherein the data byte (representing the event data) is converted into the MIDI signal. This MIDI signal is sent to a pseudo MIDI buffer as a signal used for the MIDI channel of which serial number is designated by the register ITR. The pseudo MIDI buffer is set in the storage area of the RAM 21, and this buffer is provided to store the MIDI signal which is transferred thereto in step SPn9.

After completing the pseudo MIDI process and the pseudo attenuation process (see steps SPn10 and SPn11), the processing returns to step SPn4.

① Pseudo MIDI Process

Next, the pseudo MIDI process will be described in detail by referring to FIG. 19. A subroutine of this pseudo MIDI process is provided to carry out the MIDI process in a pseudo manner. The contents of the pseudo MIDI process provided in the second embodiment is roughly similar to the contents of the MIDI process provided in the first embodiment. Steps SPo1 through SPo6 shown in FIG. 19 respectively correspond to the foregoing steps SPa1 through SPa6. However, different from the MIDI process, the pseudo MIDI process is designed to scan the pseudo MIDI buffer and carry out a pseudo note-on process and a pseudo note-off process (see steps SPo5 and SPo6).

Figure 20:
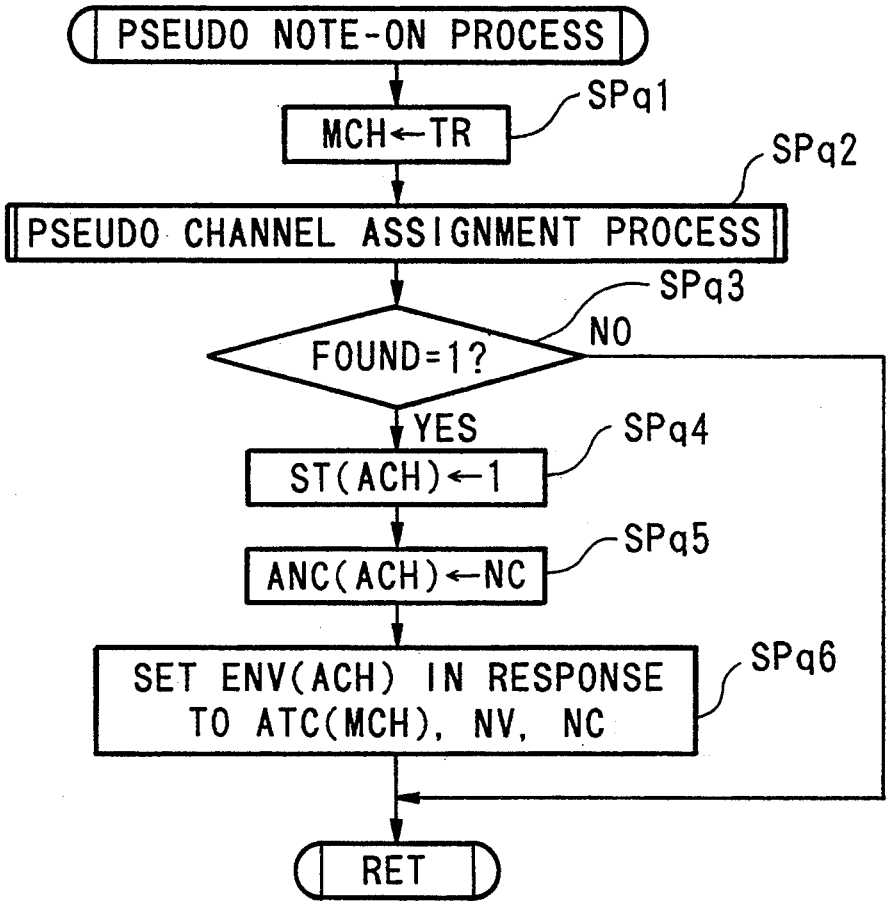
FIG. 20 is a flowchart showing a subroutine for a pseudo note-on process.

The pseudo note-on process of step SPo5 consists of steps SPq1 through SPq6 shown in FIG. 20, which are similar to the foregoing steps SPb1 through SPb6 contained in the note-on process shown in FIG. 6. However, the pseudo note-on process shown in FIG. 20 is different from the foregoing note-on process shown in FIG. 6 in the following points.

Figure 21:
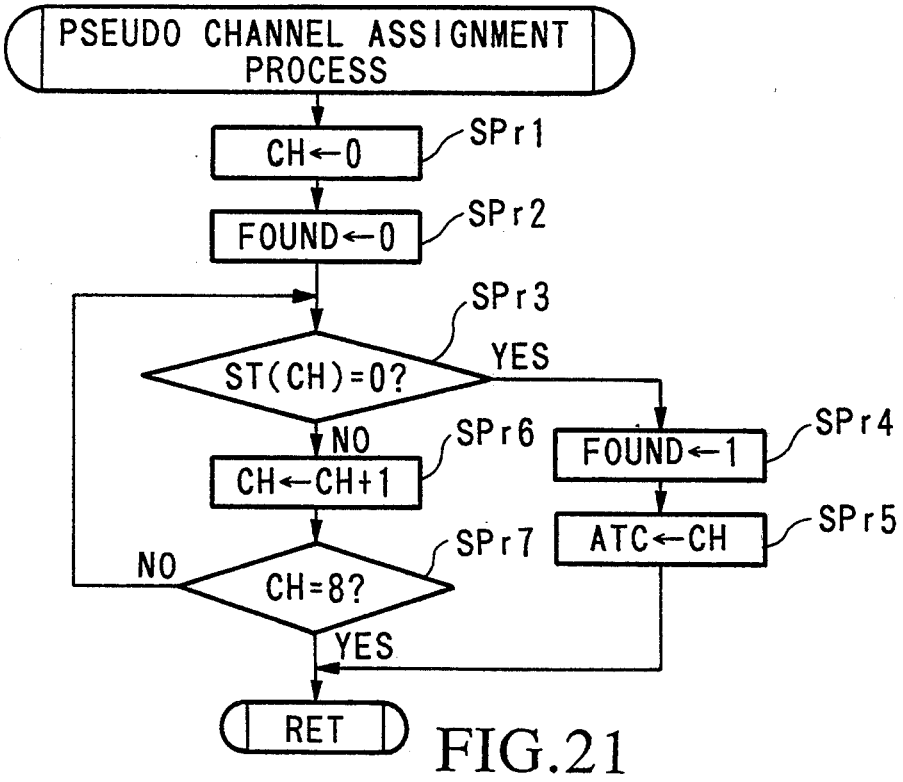
FIG. 21 is a flowchart showing a subroutine for a pseudo channel assignment process.

In step SPq1, the value of the register TR representing the serial number of the track to be accessed is written into the register MCH. This serial number corresponds to the track on which the MIDI event is detected by step SPo2 shown in FIG. 19. Each of the serial numbers of the tracks correspond to each of the serial numbers of the MIDI channels. A pseudo channel assignment process of step SPq2 consists of steps SPr1 through SPr7 shown in FIG. 21. In this process, an unoccupied channel is detected in a pseudo manner.

In the pseudo channel assignment process, the register CH which is used when scanning the channels is cleared to zero in step SPr1, and the flag FOUND is also cleared to zero in step SPr2. In step SPr3, it is judged whether or not the value of the register ST(CH) is set at "0". In other words, it is judged whether or not the currently scanned channel is an unoccupied channel . If the judgement result of step SPr3 is "YES", the processing proceeds to step SPr4 wherein the flag FOUND is set at "1". In next step SPr5, the serial number of that channel designated by the register CH is transferred to the register ATC. Thereafter, the processing returns back. On the other hand, when the judgement result of step SPr3 is "NO", the processing branches to step SPr6 wherein the serial number of the currently scanned channel (i.e., value of the register CH) is incremented by one. Then, the processing returns to step SPr3 via step SPr7. The judgement process of step SPr7 is provided to judge whether or not the scanning operation is completely carried out with respect to all of the channels. When the judgement result of step SPr7 turns to "YES", the processing returns back.

The above-mentioned pseudo channel assignment process functions to assign the tone-generation task to the channel and search the number of the channels which function to simultaneously produce the musical tones in a simplified pseudo manner. In order to simplify the operations of this process, the foregoing truncate process is not carried out. Therefore, if the CPU 12 fails to find out the unoccupied channel at a current moment, the CPU 12 declares that no unoccupied channel is existed, so that the value of the FOUND is remained at "0".

Meanwhile, the decision branching of step SPq3 shown in FIG. 20 depends on whether the flag FOUND is set at "1" or not. If the flag FOUND is remained at "0", the processing returns back from step SPq3 to the foregoing pseudo MIDI process shown in FIG. 19, from which the processing also returns back to the subroutine shown in FIG. 18. On the other hand, when it is detected that the flag FOUND is set at "1", the processing passes through steps SPq4 and SPq5 and then reaches step SPq6.

In step SPq6, a value of a register ENV(ACH) is set in response to the tone-color code stored in the register ATC(MCH) , the note velocity stored in the register NV and the note code stored in the register NC. The register ENV(ACH) is designed to score a virtual envelope value. In step SPq6, an initial value for the envelope is stored in the register ENV(ACH). This initial value is mainly determined by the note velocity.

Figure 19:
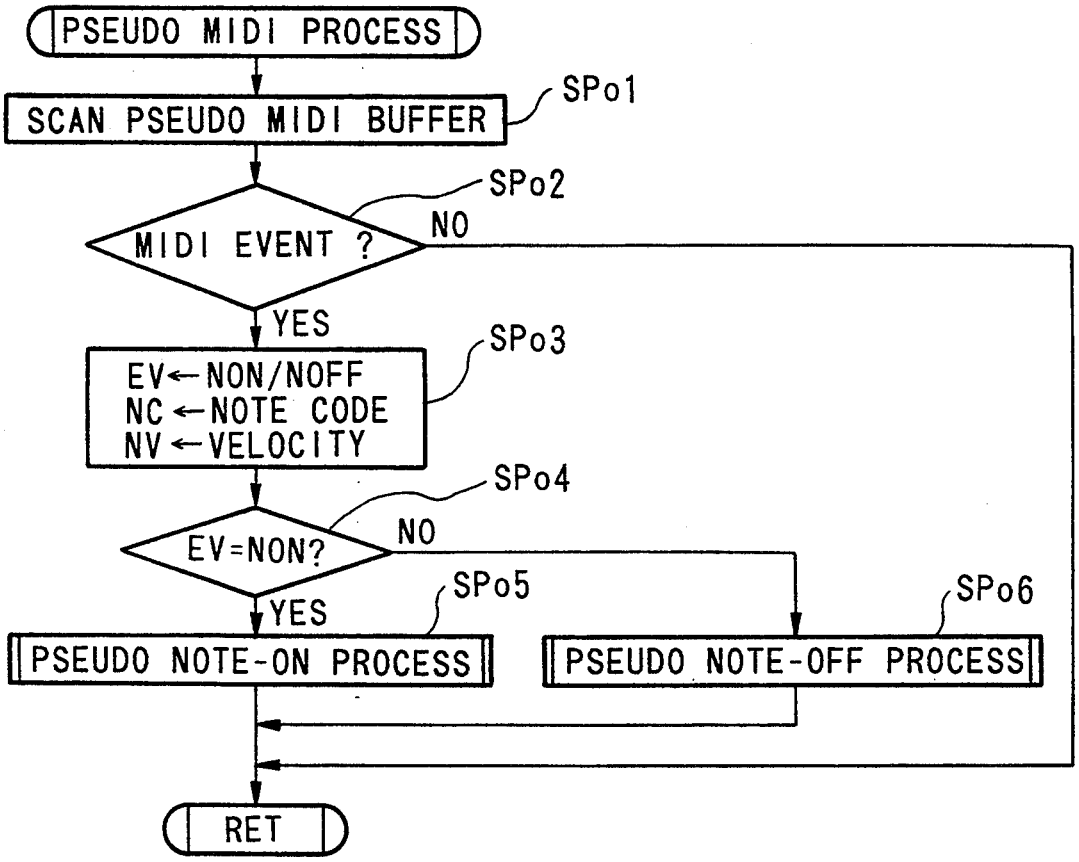
FIG. 19 is a flowchart showing a subroutine for a pseudo MIDI process.
Figure 22:
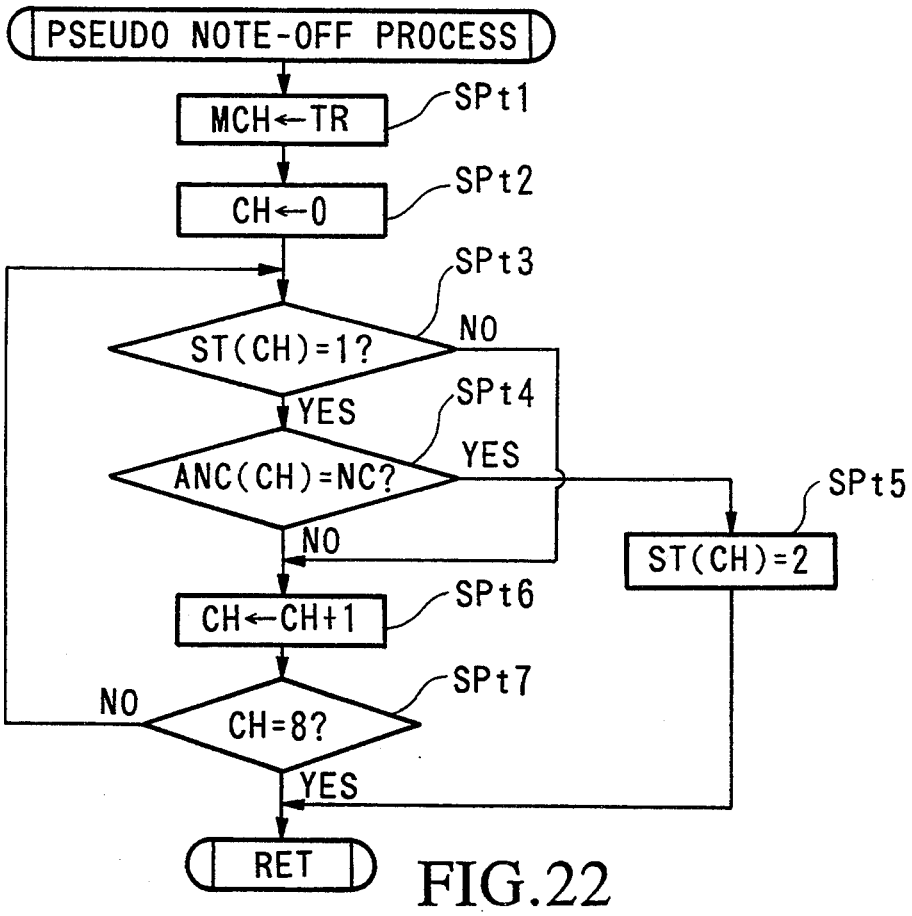
FIG. 22 is a flowchart showing a subroutine for a pseudo note-off process.

In the meantime, the pseudo note-off process of step SPo6 shown in FIG. 19 consists of steps SPt1 through SPt7 shown in FIG. 22.

In step SPt1, the serial number of the track which is now scanned by the CPU 12 is written into the register MCH. In next step SPt2, the register CH is cleared to zero. In step SPt3, it is judged whether or not the value of the register ST(CH) is set at "1", in other words, it is judged whether or not the currently scanned channel is now proceeding with the tone-generation task. If the judgement result of step SPt3 is "NO", the processing branches to step SPt6 wherein the serial number of the channel is incremented by one. Then, the processing returns to step SPt3 via step SPt7.

On the other hand, when the judgement result of step SPt4 "YES", the processing branches to step SPt5 wherein the value of the register ST(CH) is set at "2" representing the muting state of the channel. Thereafter, the processing returns back to the flowchart of FIG. 18 via the flowchart of FIG. 19, so that the processing proceeds to step SPn11 representing the pseudo attenuation process.

The judgement process of step SPt7 shown in FIG. 22 provided to judge whether or not all of the channels are completely scanned. If it is detected that all of the channels are proceeding with the tone-generation tasks, the judgement result of step SPt7 turns to "YES", so that the processing returns back.

The above-mentioned operations describe the contents of the pseudo MIDI process. After completing this pseudo MIDI process, the processing proceeds to step SPn11, representing the pseudo attenuation process, shown in FIG. 18.

(2) Pseudo Attenuation Process

Figure 23:
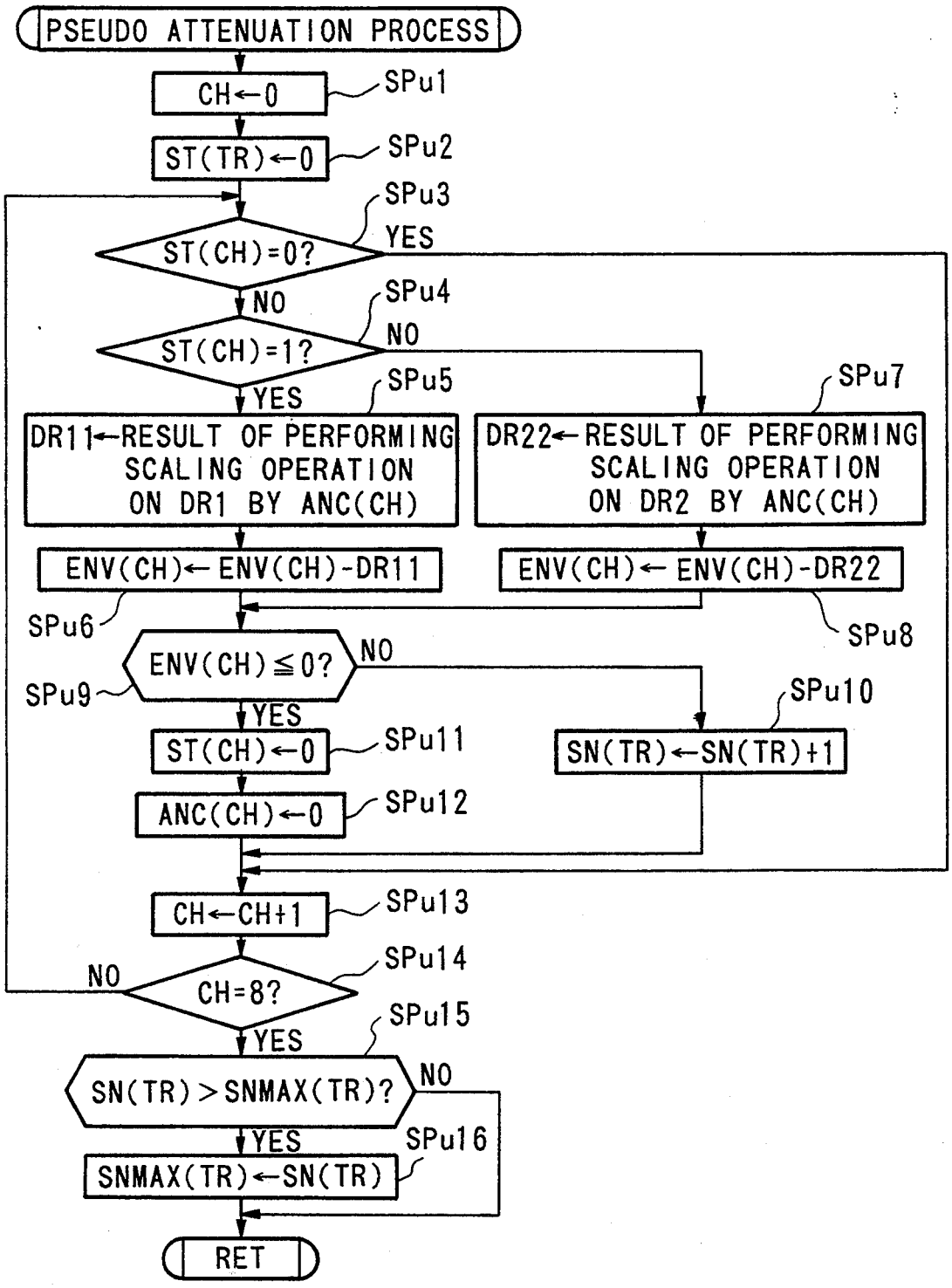
FIG. 23 is a flowchart showing a subroutine for a pseudo attenuation process.
Figure 24:
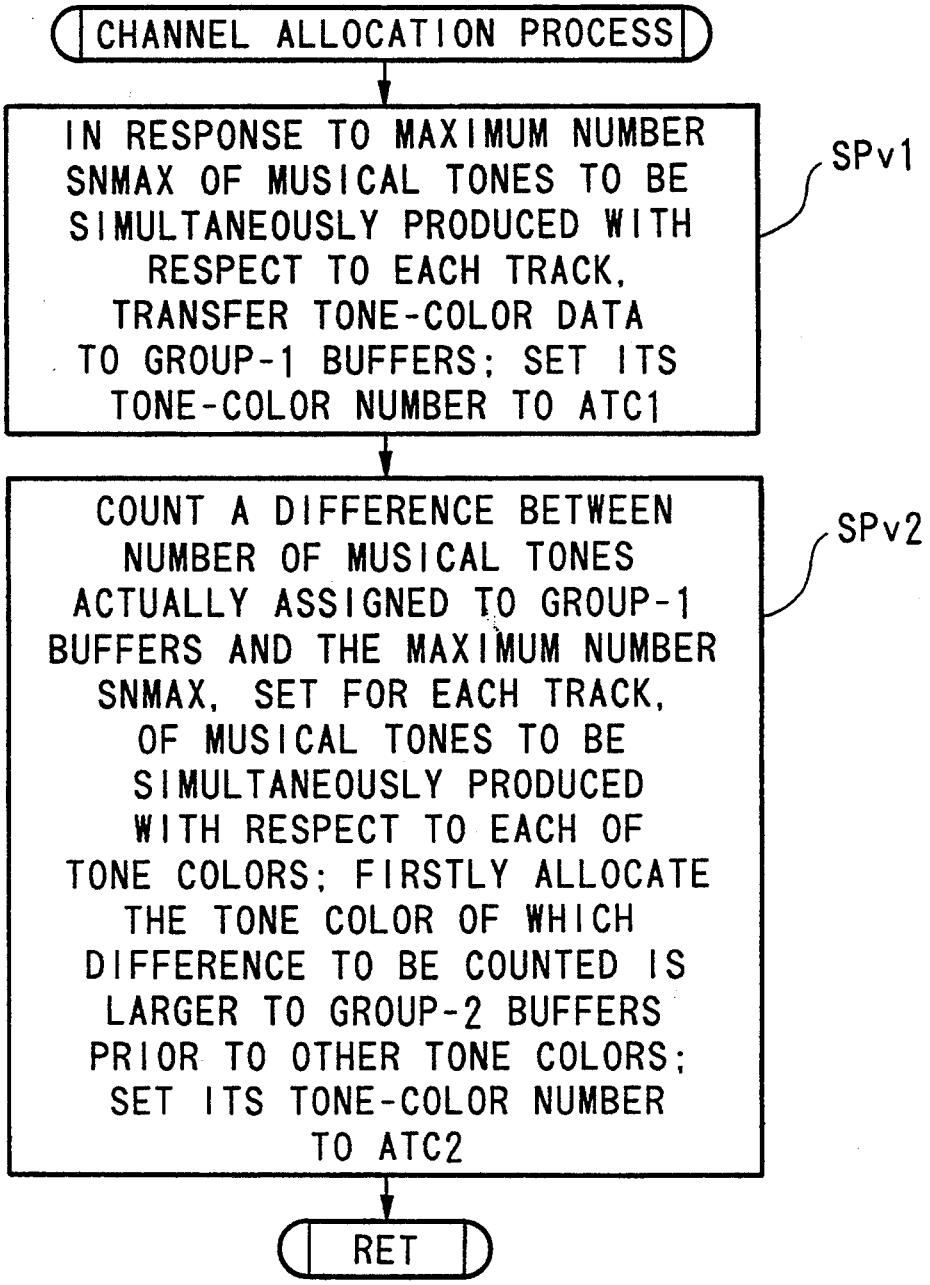
FIG. 24 is a flowchart showing a subroutine for a channel allocation process.

FIG. 23 is a flowchart showing the pseudo attenuation process. This process functions to detect the number of the musical tones to be simultaneously produced with respect to each track.

In first step SPu1, the register CH is cleared to zero. In next step SPu2, the register SN(TR) which is used for counting the number of the musical tones to be simultaneously produced is cleared to zero. In step SPu3, it is judged whether or not the currently scanned channel is the unoccupied channel. If the judgement result is "YES", the processing jumps to step SPu13 wherein the serial number of the channel to be scanned is incremented by one. Then, the processing returns to step SPu3 via step SPu14.

On the other hand, when the judgement result off step SPu3 turns to "NO", the processing proceeds to step SPu4 wherein it is judged whether or not the currently scanned channel is in a note-on state. If the judgement result is "YES", the following processes of steps SPu5 and SPu6 are carried out so that an envelope attenuation process is performed by use of an attenuation rate DR1. When the judgement result of step SPu4 turns to "NO" (indicating a note-off state), the processing branches to step SPu7. Thus, the processes of steps SPu7 and SPu8 are carried out, so that another envelope attenuation process is performed by use of another attenuation rate DR2.

Figure 25A:
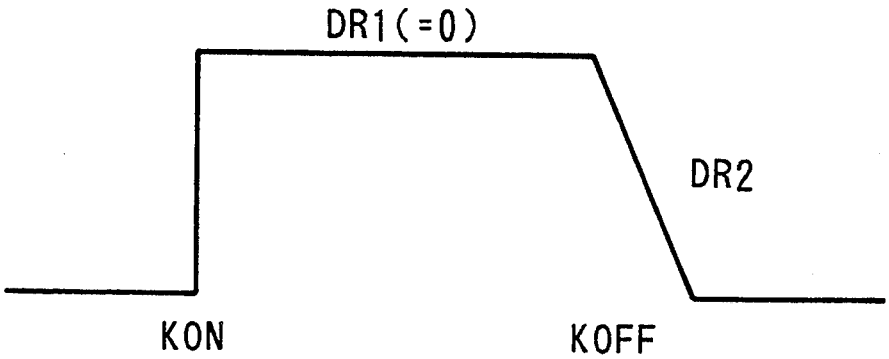
FIG. 25(A) shows an example of a waveform for a sustain-type tone.
Figure 25B:
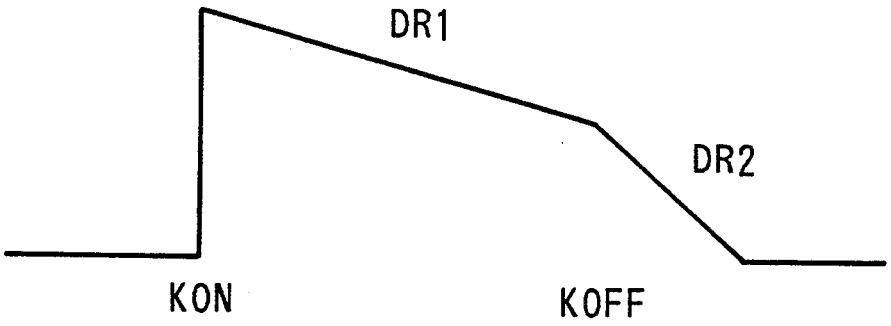
FIG. 25(B) shows an example of a waveform for a decay-type tone.
Figure 28:
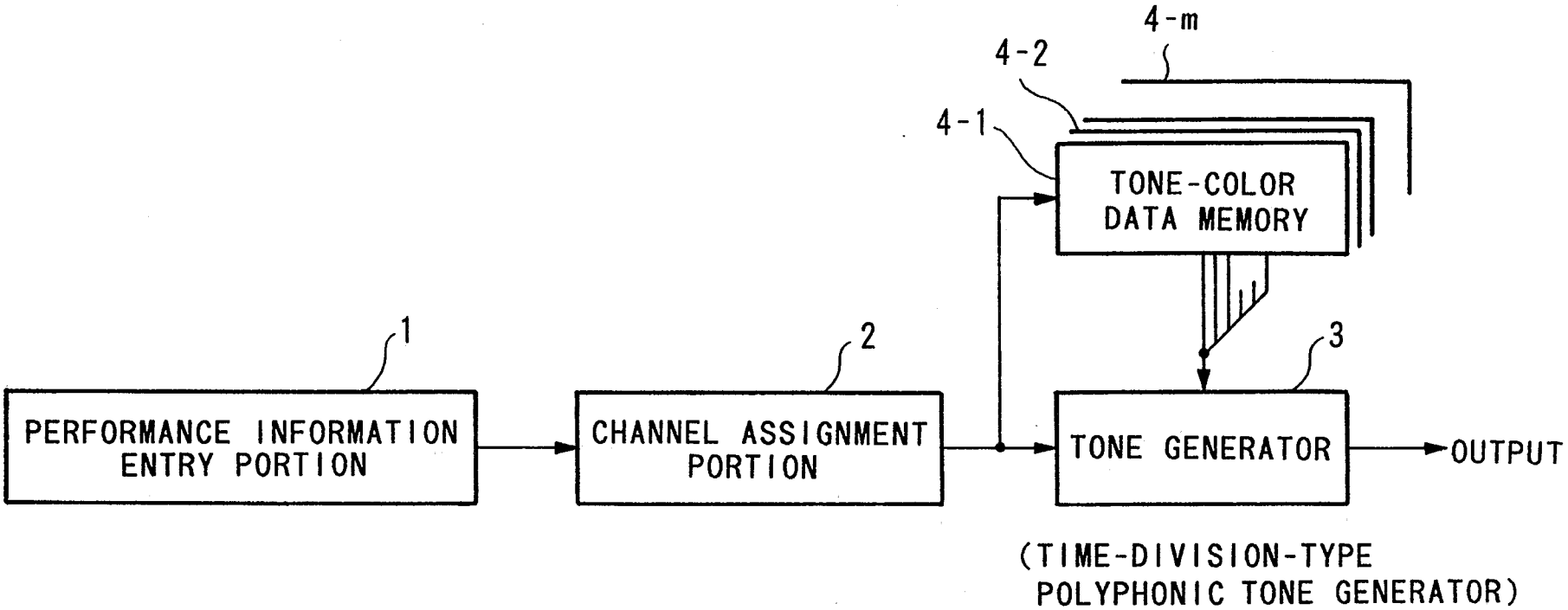
FIG. 28 is a block diagram simply showing an example of the musical tone generating apparatus.
Figure 29:
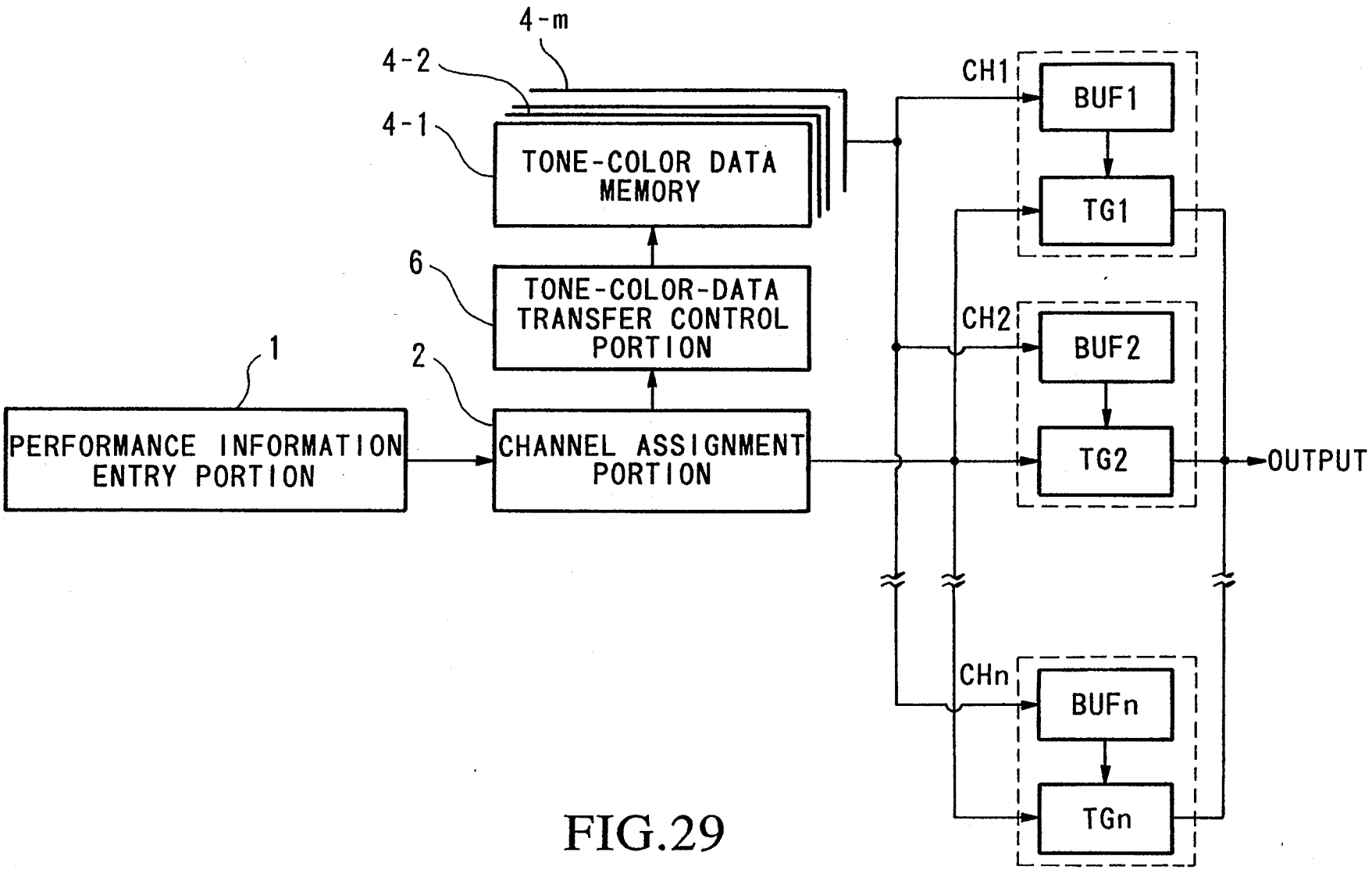
FIG. 29 is a block diagram showing another example of the musical tone generating apparatus.
Figure 30:
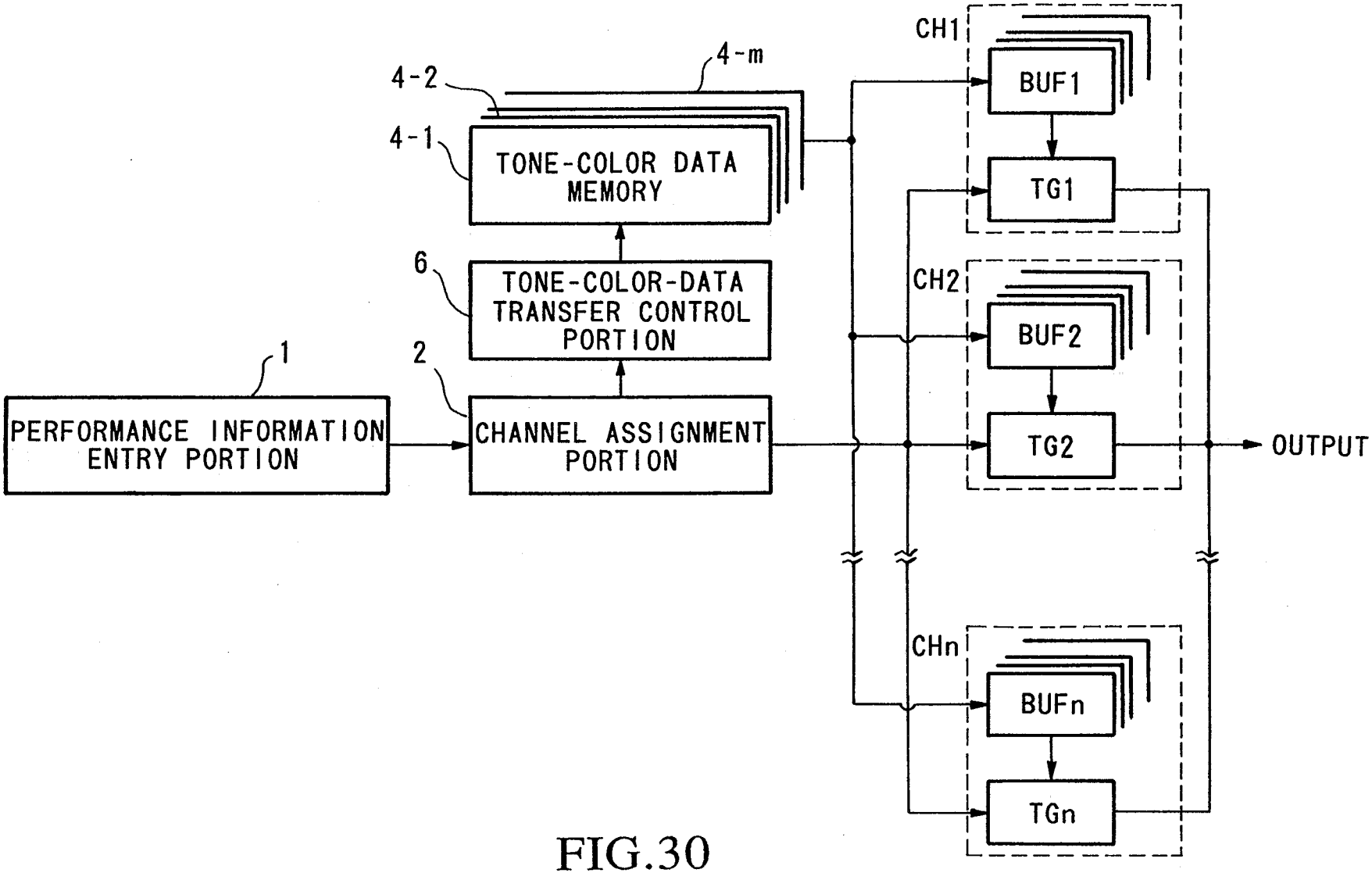
FIG. 30 is a block diagram showing a modified example of the musical tone generating apparatus.

FIGS. 25A and 25B show waveforms representing envelope patterns, wherein FIG. 25A shows an example of the envelope waveform for a sustain-type tone (e.g., musical tone of organ), while FIG. 25B shows an example of the envelope waveform for a decay-type tone (e.g., musical tone of piano). Herein, "DR1" represents an attenuation rate note-on period, while "DR2" represents another attenuation rate in a note-off period. In the sustain-type tone as shown in FIG. 25A, an envelope level in the note-on period is constant, so that the attenuation rate DR1 is set at "0".

A plenty of envelope patterns are set in advance with respect to each of the tone colors, so that one of them is selected in response to the tone-color code. In other words, the attenuation rates DR1 and DR2 are determined at certain values corresponding to the tone -color code.

in step SPu5, the attenuation rate DR1 is subjected to the scaling operation by use of the note code stored in the register ANC(CH), so that the result thereof is set as an attenuation rate DR11. Such operation is necessary in order to provide a different attenuation rate with respect to each of the tone pitches. In next step SPu6, the value off the attenuation rate DR11 is subtracted from the envelope value stored in the register ENV(CH), so that the result of the subtraction is written into the register ENV(CH). In short, the envelope value of the register ENV(CH) is reduced by the value of the attenuation rate DR11. Processes of steps SPu7 and SPu8 are respectively similar to those of steps SPu5 and SPu6. In these processes of steps SPu7 and SPu8, the attenuation rate DR2 is subjected to the scaling operation by use of the note code stored in the register ANC(CH), and then, the result thereof (i.e., DR22) is subtracted from the envelope value of the register ENV(CH) .

In step SPu9, it is judged whether or not the envelope value which is renewed by the above-mentioned process SPu6 or SPu8 becomes equal to or less than "0". If the judgement result is "NO", the processing branches to step SPu10 wherein the value of the register SN(TR) is incremented by one. In the case where the envelope value is larger than "0", the musical tone produced from the currently scanned channel has not been muted yet. In this case, it is necessary to increment the value of the register which stores the number of the musical tones to be simultaneously produced. For this reason, the process of step SPu10 is carried out.

On the other hand, when the judgement result of step SPu9 turns to "YES", it is detected that the currently scanned channel has muted the musical tone. At this time, the value of the register ST(CH) representing the state of the channel is reset to zero in step SPu11. In next step SPu12, the value of register ANC(CH) is cleared to zero.

After completing the process of step SPu10 or SPu12, the processing proceeds to step SPu13 wherein the serial number of the channel to be scanned is incremented by one. Then, the processing returns to step SPu8 via step SPu14.

The judgement process of seep SPu14 is provided to judge whether or not all of the channels have been scanned. If the judgement result of step SPu14 turns to "YES", the processing proceeds to step SPu15 wherein it is judged whether or not the value of the register SN(TR) is larger than the value of the register SNMAX(TR). In other words, it is judged whether or not the number of the musical tones to be simultaneously produced, which is detected by the current scanning cycle, is larger than the maximum number of the musical tones to be simultaneously produced, which has been previously detected in the previous scanning cycles. If the judgement result of step SPu15 is "YES", the value of the register SNMAX(TR) (which stores the previous maximum number of the musical tones to be simultaneously produced) is rewritten by the value of the register SN(TR) in step SPu16. Then, the processing returns back from step SPn11 to step SPn4 shown in FIG. 18. On the other hand, when the judgement result of step SPu15 is "NO", the above-mentioned rewriting operation of step SPu16 is not carried out, so that the processing directly returns back to step SPn4 shown in FIG. 18.

Thereafter, the above-mentioned processes are repeatedly carried out. As a result, the register SNMAX(TR) will eventually store the maximum number of the musical tones to be simultaneously produced with respect to each of the tracks of the sequencer.

③ Channel Allocation Process

When the above-mentioned processes are completely carried out with respect to all of the channels, the judgement result of step SPn13 shown in FIG. 18 turns to "YES" so that the processing proceeds to step SPn14 representing the channel allocation process. The channel allocation process consists of steps SPv1 and SPv2 shown in FIG. 24. In first step SPv1, the data are respectively transferred to the group-1 buffers BUF0-1 through BUF7-1 in response to the maximum number of the musical tones to be simultaneously produced in connection with each track (which is designated by the value of the register SNMAX(TR)). In the second embodiment, micro-programs used in the tone generators are employed as the data to be transferred.

As a method to allocate the channels, the second embodiment employs predetermined allocation rules. According to one example of the rules, the tone color corresponding to the maximum number of the musical tones to be simultaneously produced is selected prior to the other tone colors, so that the channels are firstly allocated to the selected tone color. Or, according to another example of the rules, the musical instrument of which degree of importance is the highest is selected prior to the other instruments, so that the tone color corresponding to the selected instrument is firstly allocated to the channels. Next, the allocation manner will be described with respect to a condition where the maximum number of the piano sounds to be simultaneously produced is set at "8"; the maximum number of the stringed-instrument sounds to be simultaneously produced is set at "6"; the maximum number of the brass-instrument sounds to be simultaneously produced is set at "1"; and the maximum number of the bass sounds to be simultaneously produced is also set at "1". Under this condition, piano-sound data are transferred to the buffers BUF0-1 through BUF3-1; stringed-instrument-sound data are transferred to the buffers BUF4-1 through BUF6-1; and bass-sound data is transferred to the buffer BUF7-1.

Further, in step SPv1, the contents of the group-1 tone colors stored in the tone-color assignment buffer as shown in FIG. 2 are rewritten responsive to the contents of the data written in the buffers. Furthermore, each of the serial numbers of those tone colors is set to the register ATC1(CH).

In next step SPv2, the CPU 12 selects a certain tone color prior to the other tone colors in accordance with a certain tone-color selection algorithm when allocating the tone color to the buffers. According to this algorithm, a difference is counted between a number of the group-1 buffers to be allocated with the same tone color and the maximum number of the musical tones to be simultaneously produced by use of that same tone color in connection with each of the tracks. Then, the tone color corresponding to the largest difference is firstly allocated to the group-2 buffers prior to the other tone colors.

In the aforementioned condition, four out of eight piano sounds are allocated to the group-1 buffers BUF0-1 through BUF3-1, so that a difference can be counted to be equal to "4" representing a number of the piano sounds which are not allocated to the group-1 buffers. Similarly, three out of six stringed-instrument sounds are allocated to the group-1 buffers BUF4-1 through BUF6-1, so that a difference can be counted to be equal to "3" representing a number of the stringed-instrument sounds which are not allocated to the group-1 buffers. Further, no brass-Instrument sound is allocated to the group-1 buffer, so that a difference can be counted to be equal to "1".

In the above-mentioned state, the remained four piano-sound data are respectively transferred to the group-2 buffers BUF0-2 through BUF3-2; the remained three stringed-instrument-sound data are respectively transferred to the buffers BUF4-2 through BUF6-2; and the brass-instrument-sound data is transferred to the buffer BUF7-2. Furthermore, in step SPv2, the contents of the group-2 tone colors stored in the tone-color assignment buffer 23 as shown in FIG. 2 are rewritten responsive to the written contents of the group-2 buffers. Moreover, each of the serial numbers of the group-2 tone colors is stored in the register ATC2(CH).

Meanwhile, if the aforementioned difference regarding to the piano sound is equal to "5" so that the process of step SPv2 functions to allocate those five piano-sound data to the group-2 buffers in advance, there remains no group-2 buffer to which the brass-instrument data can be allocated. In such case, the number of the piano-sound data to be allocated to the group-2 buffers is limited to "4" so as to secure the channel for the brass-instrument data. Thus, the allocation rules can be adjusted such that no instrument is neglected when producing the musical tones.

[F] Modifications

① In the aforementioned embodiments, there are provided two buffers storing the tone-color data with respect to one tone generator. The number of the buffers to be provided with respect to the tone generator can be increased. FIG. 26 shows a third embodiment wherein four buffers are provided with respect to one tone generator. Thus, there are provided four groups of the buffers. In FIG. 26, there are provided plural tone generators TG0 through TGn, while tone-color data memories 50 store one-hundred tone-color data each of which can be transferred to each of the buffers. A tone-color data transfer designating portion 52 corresponds to the -foregoing tone-color assignment buffer 23, whereas FIG. 27 shows an example of the stored contents thereof. Upon the receipt of the designating instruction from the tone-color data transfer designating portion 52, a tone-color data transfer control portion 51 selectively transfer each of the tone-color data, stored in the tone-color data memories 50, by referring to the table shown in FIG. 27.

A performance information entry portion 53 shown in FIG. 26 is a keyboard unit, for example. As similar to the aforementioned embodiments, the performance information entry portion 53 forms and outputs time MIDI signal. A channel assignment portion 54 assigns the output signal (representing the note code and the like) of the performance information entry portion 53 to each of the tone generators.

② In the case similar to the aforementioned example ① where plural groups of the buffers are provided, a group-x tone color can be assigned to the buffer prior to another group-y tone color (where $x<y$). 0r, the group-1 tone colors are given a first priority when being allocated to the buffers, while the other groups of the tone colors are given a second priority, so that the group-1 tone colors are firstly allocated to the buffers prior to the other tone colors, while the other groups of the tone colors are equally allocated to the buffers. ③ In the second embodiment, the sequencer is virtually driven so as to detect the number of the musical tones to be simultaneously produced with respect to each off the tracks. Instead, when detecting such number, it is possible to actually drive the sequencer and the musical tone synthesizing circuit, Thus, it is possible to accurately obtain the number of the musical tones to be simultaneously produced.

(4) The aforementioned embodiments employ the micro-programs as the tone-color data to be transferred to the buffers of the channel. However, the present invention is not limited to such application. It is possible to easily modify the present embodiments such that the parameters For setting the tone colors are transferred to the channel.

Lastly, this invention may be practiced or embodied in still other ways without departing from the spirit or essential character thereof as described heretofore. Therefore, the preferred embodiments described herein are illustrative and not restrictive, the scope of the invention being indicated by the appended claims and all variations which come within the meaning of the claims are intended to be embraced therein.

What is claimed is:

1. A musical tone generating apparatus comprising:

a plurality of channel means each containing one musical tone creating portion and plural buffers, each of said buffers being capable of storing tone-color data designating one tone color;

tone-color data storing means for storing a plurality of tone-color data in advance, of which number is larger than a number of said buffers provided in said plurality of channel means;

a designating means for designating plural tone-color data to be assigned to said buffers among said plurality of tone-color data stored in said tone-color data storing means;

a searching means for searching one of said plurality of channel means which has a function to produce a musical tone corresponding to musical tone information, given thereto to designate a generation of the musical tone, by referring to said tone-color data stored in said buffers; and an assigning means for assigning a tone-generation task to generate the musical tone to the channel means searched by said searching means, whereby in the channel means searched by said searching means, said musical tone creating portion thereof creates a musical tone signal corresponding to said musical tone information by use of the tone-color data stored in the buffer corresponding to said musical tone information.

2. A musical tone generating apparatus, which generates a musical tone signal having a tone color corresponding to musical tone information given thereto, comprising:

a plurality of channel means each containing one musical tone creating portion and two or more buffers, each of said buffers being capable of storing tone-color data designating one tone color, while said musical tone creating portion creates a musical tone signal having a tone color corresponding to said tone-color data stored in one of said buffers;

a control means for classifying all of said buffers into two or more groups among said plurality of channel means in accordance with a predetermined priority order so that in each channel means, a buffer belonging to one group is given a first priority and selected prior to another buffer belonging to another group;

tone-color data storing means for storing a plurality of tone-color data in advance, of which number is larger than a number of said buffers provided in said plurality of channel means;

a designating means for designating one of said plurality of tone-color data to be assigned to each of said buffers; and a transfer means for transferring the tone-color data to the buffers in accordance with a designation of said designating means, wherein said control means selects the channel means which contains the buffer storing the tone-color data corresponding to said musical tone information in accordance with said priority order, while said musical tone creating portion of a selected channel means eventually creates a musical tone signal corresponding to said musical tone information.

3. A musical tone generating apparatus comprising:

a plurality of channel means each containing one musical tone creating portion and two or more buffers, each of said buffers being capable of storing tone-color data designating one tone color, while said musical tone creating portion creates a musical tone signal having a tone color corresponding to said tone-color data stored in one of said buffers;

a control means for classifying all of said buffers into two or more groups among said plurality of channel means in accordance with a buffer-grouping procedure so that in each channel means, a buffer belonging to one group is given a first priority and selected prior to another buffer belonging to another group when being allocated with said tone-color data;

tone-color data storing means for storing a plurality of tone-color data in advance, of which number is larger than a number of said buffers provided in said plurality of channel means; and a tone-color allocating means for allocating said tone-color data to said buffers in accordance with a tone-color-allocation order which is determined responsive to characteristics of a tune to be performed, so that said tone-color data allocated to said buffers are classified into two or more groups in a manner similar to said buffer-grouping procedure employed for said buffers.

4. A musical tone generating apparatus, which generates a musical tone signal having a tone color based on musical tone information read from a storage means, comprising:

a plurality of channel means each containing one musical tone creating portion and two or more buffers, each of said buffers being capable of storing tone-color data designating one tone color, while said musical tone creating portion creates a musical tone signal having a tone color corresponding to said tone-color data stored in one of said buffers;

tone-color data storing means for storing a plurality of tone-color data in advance, of which number is larger than a number of said buffers provided in said plurality of channel means;

a designating means for designating one of said plurality of tone-color data stored in said tone-color data storing means;

a transfer means for transferring the tone-color data designated by said designating means to said buffers;

a detecting means for reading said musical tone information from said storage means so as to detect a maximum number of musical tones to be simultaneously produced with respect to each of the tone colors corresponding to read musical tone information; and an allocating means for automatically allocating said tone-color data to said buffers in accordance with a tone-color-allocation order by which the tone color of which maximum number detected by said detecting means is larger is allocated to a larger number of buffers among said plurality of channel means and by which the tone colors corresponding to said musical tone information are certainly allocated to said buffers.

5. A musical tone generating apparatus as defined in claim 4 wherein in order to detect the maximum number of musical tones to be simultaneously produced with respect to each of the tone colors, said detecting means reads out said musical tone information for an automatic performance at a velocity which is faster than a normal performing velocity, so that data used for the automatic performance which is carried out at the normal performing velocity are set by carrying out several kinds of processes within said apparatus in a pseudo manner.

6. A musical tone generating apparatus as defined in claim 4 wherein said detecting means does not function to produce a musical tone when reading out said musical tone information.

* * * * *